US012286719B2

(12) United States Patent
Underwood et al.

(10) Patent No.: US 12,286,719 B2
(45) Date of Patent: Apr. 29, 2025

(54) ELECTRODEPOSTION OF METALS FROM LIQUID MEDIA

(71) Applicant: BOARD OF REGENTS, THE UNIVERSITY OF TEXAS SYSTEM, Austin, TX (US)

(72) Inventors: Thomas C. Underwood, Austin, TX (US); Sheila Gerardo, Austin, TX (US); Wen Song, Austin, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 0 days.

(21) Appl. No.: 17/729,268

(22) Filed: Apr. 26, 2022

(65) Prior Publication Data

US 2022/0341050 A1 Oct. 27, 2022

Related U.S. Application Data

(60) Provisional application No. 63/179,817, filed on Apr. 26, 2021.

(51) Int. Cl.

| | |
|---|---|
| ***C25C 1/00*** | (2006.01) |
| ***C22B 26/12*** | (2006.01) |
| ***C25C 1/02*** | (2006.01) |

(52) U.S. Cl.

CPC ..... *C25C 1/02* (2013.01); *C22B 26/12* (2013.01)

(58) Field of Classification Search

CPC ..... C25C 1/02; C22B 26/12

See application file for complete search history.

(56) References Cited

U.S. PATENT DOCUMENTS

2013/0047783 A1* 2/2013 Wong ..... C22B 7/005 75/10.67
2018/0112291 A1* 4/2018 Waller, Jr. ..... C22B 3/26
2020/0399737 A1* 12/2020 Tran ..... C22B 26/12

FOREIGN PATENT DOCUMENTS

CN 104112882 A 10/2014
CN 103031568 B 4/2016
CN 106823816 B 4/2020

OTHER PUBLICATIONS

United States Geological Survey (USGS). Mineral Commodity Summaries 2020; 2020.

Albemarle. Global Lithium Market Outlook. Goldman Sachs HCID Conf. No. Mar. 30, 2016.

Blondes, M. S.; Gans, K. D.; Engle, M. A.; Kharaka, Y. K.; Reidy, M. E.; Saraswathula, V.; Thordsen, J. J.; Rowan, E. L.; Morrissey, E. A. U.S. Geological Survey National Produced Waters Geochemical Database (Ver. 2.3, Jan. 2018): U.S. Geological Survey Data Release; 2018. https://doi.org/10.5066/F7J964W8.

(Continued)

*Primary Examiner* — Zulmariam Mendez

(74) *Attorney, Agent, or Firm* — Meunier Carlin & Curfman LLC

(57) ABSTRACT

Disclosed are methods for direct electrodeposition of a metal from the liquid medium. The methods include electroreduction of lithium anions on cathode electrodes in the presence of various metal deposition selectivity enhancements. The selectivity enhancement disclosed herein comprises the presence of a magnet, a solvent that is immiscible with an original liquid medium comprising the desired metal ions or various separators. Also disclosed are systems for electrodeposition of the desired metals from the liquid medium.

22 Claims, 7 Drawing Sheets

(56) References Cited

OTHER PUBLICATIONS

Li, L.; Deshmane, V. G.; Paranthaman, M. P.; Bhave, R.; Moyer, B. A.; Harrison, S. Lithium Recovery from Aqueous Resources and Batteries: A Brief Review. Johnson Matthey Technol. Rev. 2018, 62 (2), 161-176.
Flexer, V.; Baspineiro, C. F.; Galli, C. I. Lithium Recovery from Brines: A Vital Raw Material for Green Energies with a Potential Environmental Impact in Its Mining and Processing. Sci. Total Environ. 2018, 639. https://doi.org/10.1016/j.scitotenv.2018.05.223.
Whittingham, M. S. Electrical Energy Storage and Intercalation Chemistry. Science 1126-1127. 1976, 192(4244). DOI: 10.1126/science.192.4244.1126.
Goodenough, J. B.; Park, K. S. The Li-Ion Rechargeable Battery: A Perspective. J. Am. Chem. Soc. 2013. https://doi.org/10.1021/ja3091438.
Eric C. Evarts. To the Limits of Lithium. Nature 2015, 526, S93-S95.
Chan, C. K.; Peng, H.; Liu, G.; Mcllwrath, K.; Zhang, X. F.; Huggins, R. A.; Cui, Y. High-Performance Lithium Battery Anodes Using Silicon Nanowires. Nat. Nanotechnol. 2008, 3 (1), 31-35.
Halsey, T. C.; Leibig, M. Electrodeposition and Diffusion-Limited Aggregation Electrodepositlon and Diffusion-Limited Aggregation. J. Chem. Phys. 1990, 92. https://doi.org/10.1063/1.457834.
Sander, L. M. Fractal Growth Processes. Nature 1986, 322 (6082), 789-793.
Ragsdale, S. R.; Lee, J.; Gao, X.; White, H. S. Magnetic Field Effects in Electrochemistry. Voltammetric Reduction of Acetophenone at Microdisk Electrodes. J. Phys. Chem. 1996, 100 (14), 5913-5922. https://doi.org/10.1021/jp9532024.
Razmjou, A.; Eshaghi, G.; Orooji, Y.; Hosseini, E.; Korayem, A. H.; Mohagheghian, F.; Boroumand, Y.; Noorbakhsh, A.; Asadnia, M.; Chen, V. Lithium Ion-Selective Membrane with 2D Subnanometer Channels. Water Res. 2019, 159, 313-323.
Razmjou, A.; Asadnia, M.; Hosseini, E.; Habibnejad Korayem, A.; Chen, V. Design Principles of Ion Selective Nanostructured Membranes for the Extraction of Lithium Ions. Nat. Commun. 2019, 10 (1), 1-16.
Huang, W.; Attia, P. M.; Wang, H.; Renfrew, S. E.; Jin, N.; Das, S.; Zhang, Z.; Boyle, D. T.; Li, Y.; Bazant, M. Z.; et al. Evolution of the Solid-Electrolyte Interphase on Carbonaceous Anodes Visualized by Atomic—Resolution Cryogenic Electron Microscopy. Nano Lett. 2019, 19, 5140-5148.
Bai, P.; Li, J.; Brushett, F. R.; Bazant, M. Z. Transition of Lithium Growth Mechanisms in Liquid Electrolytes. Energy Environ. Sci. 2016, 9 (10), 3221-3229. https://doi.org/10.1039/c6ee01674j.
Liu, K.; Liu, Y.; Lin, D.; Pei, A.; Cui, Y. Materials for Lithium-Ion Battery Safety. Sci. Adv. 2018, 4 (6).
Hinds, G.; Spada, F. E.; Coey, J. M. D.; Ní Mhíocháin, T. R.; Lyons, M. E. G. Magnetic Field Effects on Copper Electrolysis. J. Phys. Chem. B 2001, 105 (39), 9487-9502. https://doi.org/10.1021/jp010581u.
Waskaas, M. Short-Term Effects of Magnetic Fields on Diffusion in Stirred and Unstirred Paramagnetic Solutions. J. Phys. Chem. 1993, 97 (24), 6470-6476. https://doi.org/10.1021/j100126a023.
Lee, D. A.; Taylor, W. L.; McDowell, W. J.; Drury, J. S. Solvent Extraction of Lithium. J. Inorg. Nucl. Chem.1968, 30, 2807-2821. https://doi.org/10.1016/0022-1902(68)80410-5.

* cited by examiner

ELECTRODEPOSTION OF METALS FROM LIQUID MEDIA

CROSS-REFERENCE TO RELATED APPLICATIONS

This application claims the benefit of U.S. Provisional Application No. 63/179,817 filed Apr. 26, 2021, the content of which is incorporated herein by reference in its entirety.

TECHNICAL FIELD

This application relates generally to methods of direct and selective electrodeposition of metal, e.g., lithium metal, from a liquid medium comprising ions of the desired metal to be deposited and possibly ions of other metals and systems for obtaining the deposited metal.

BACKGROUND

Lithium-ion ($Li^+$) batteries (LIBs) underlie the viability of renewable energy technologies through energy storage and vehicle electrification. In 2019, the U.S. had a net lithium import reliance of ≳25% due to a lack of domestic production, extraction, and processing. The development of U.S. renewable energy infrastructure, therefore, depends upon foreign resources from Argentina, Chile, China, and Australia. The increasing demand for lithium metal ($Li_s$) for use in batteries and other applications (FIG. 1), in combination with its lack of domestic availability, makes Li a critical material. Lithium demand has been increasing due to the continuous miniaturization of electronic devices, the use of electric vehicles, and the continuous demand for renewable energy technology. The growth in the use of electric vehicles is projected to increase the Li demand to >1 million tons of lithium carbonate (LCE) equivalent by 2030.

Favorably, unconventional domestic resources possess significant lithium resource potential. Produced waters from hydrocarbon wells (e.g., Permian, Gulf coast basins) and geothermal brines (e.g., Great Basin) contain $Li^+$ concentrations of ~100 to 1000 ppm and ~10 ppm, respectively (FIGS. 2A and 2B).

The recovery of lithium, however, poses a technical and economic challenge. For example, recovery of lithium currently employs processes such as evaporation, solvent extraction, sorbents ion exchange, and membranes are limited by economics, production rate, product purity, and environmental impact.

The challenges with lithium recovery are similar to the challenges associated with the recovery of other metals from liquid media. High-cost, environmentally unfriendly, and low-yielding processes are currently being used to recover a variety of other metals. Thus, new systems and methods are needed to provide an efficient, economically viable, and environmentally friendly recovery of metals. These needs and other needs are at least partially satisfied by the present disclosure.

SUMMARY

The present disclosure is directed to a method for selective recovery of a metal from a liquid medium comprising ions of the metal wherein the method comprises: applying a voltage to an electrochemical cell comprising the liquid medium, an anode, and a cathode to induce an electric current flow from the anode to the cathode, wherein the voltage is effective to induce a reduction of the metal ions on the cathode; applying a magnetic field directed orthogonally to the current flow to induce an azimuthal motion of the liquid medium, thereby rotating the liquid medium around the cathode; depositing reduced metal on the cathode; and recovering the reduced metal.

Also is disclosed a method for selective recovery of a metal from a liquid medium comprising ions of the metal wherein the method comprises: applying a voltage to an electrochemical cell comprising the liquid medium, a further solvent, an anode, and a cathode to induce an electric current flow from the anode to the cathode, wherein the voltage is effective to induce a reduction of the metal ions on the cathode; and wherein the further solvent is substantially immiscible with the liquid medium and is in flow communication with the cathode; depositing reduced metal on the cathode, and recovering the reduced metal.

In yet further aspects, disclosed herein is a method for selective recovery of a metal from a liquid medium comprising ions of the metal wherein the method comprises: applying a voltage to an electrochemical cell comprising the liquid medium, an anode, and a cathode to induce an electric current flow from the anode to the cathode, wherein the voltage is effective to induce a reduction of the metal ions on the cathode; wherein the electrochemical cell further comprises a separator positioned between the cathode and anode, and wherein the separator is substantially permeable and selective to the metal ions; depositing reduced metal on the cathode, and recovering the reduced metal.

In yet further aspects, disclosed herein is a method for selective recovery of a metal from a liquid medium comprising ions of the metal wherein the method comprises: applying a voltage to an electrochemical cell comprising the liquid medium, a further solvent, an anode, and a cathode to induce an electric current flow from the anode to the cathode, wherein the voltage is effective to induce a reduction of the metal ions on the cathode; and wherein the further solvent is substantially immiscible with the liquid medium and is in flow communication with the cathode; applying a magnetic field directed orthogonally to the current flow to induce an azimuthal motion of the liquid medium, thereby rotating the liquid medium around the cathode; depositing reduced metal on the cathode; and recovering the reduced metal.

Also disclosed is a method for selective recovery of a metal from a liquid medium comprising ions of the metal wherein the method comprises: applying a voltage to an electrochemical cell comprising the liquid medium, an anode, and a cathode to induce an electric current flow from the anode to the cathode, wherein the voltage is effective to induce a reduction of the metal ions on the cathode; wherein the electrochemical cell further comprises a separator positioned between the cathode and anode, and wherein the separator is substantially permeable and selective to the metal ions; applying a magnetic field directed orthogonally to the current flow to induce an azimuthal motion of the liquid medium, thereby rotating the liquid medium around the cathode; depositing reduced metal on the cathode; and recovering the reduced metal.

Still further disclosed is a method for selective recovery of a metal from a liquid medium comprising ions of the metal wherein the method comprises: applying a voltage to an electrochemical cell comprising the liquid medium, a further solvent, an anode, and a cathode to induce an electric current flow from the anode to the cathode, wherein the voltage is effective to induce a reduction of the metal ions on the cathode; and wherein the further solvent is substantially immiscible with the liquid medium and is in flow communication with the cathode; wherein the electrochemical cell further comprises a separator positioned between the cathode and anode, and wherein the separator is substantially permeable and selective to the metal ions; applying a magnetic field directed orthogonally to the current flow to induce an azimuthal motion of the liquid medium, thereby rotating the liquid medium around the cathode; depositing reduced metal on the cathode; and recovering the reduced metal.

Still further disclosed is a method for selective recovery of a metal from a liquid medium comprising ions of the metal wherein the method comprises: applying a voltage to an electrochemical cell comprising the liquid medium, a further solvent, an anode, and a cathode to induce an electric current flow from the anode to the cathode, wherein the voltage is effective to induce a reduction of the metal ions on the cathode; and wherein the further solvent is substantially immiscible with the liquid medium and is in flow communication with the cathode; wherein the electrochemical cell further comprises a separator positioned between the cathode and anode, and wherein the separator is substantially permeable and selective to the metal ions; depositing reduced metal on the cathode, and recovering the reduced metal.

Also disclosed herein is a method for selective recovery of a metal from a liquid medium comprising ions of the metal wherein the method comprises: applying a voltage to an electrochemical cell comprising the liquid medium, an anode and a cathode to induce an electric current flow from the anode to the cathode, wherein the voltage is effective to induce a reduction of the metal ions on the cathode; depositing reduced metal on the cathode; wherein the deposited reduced metal forms a plurality of fractal dendrites, a mossy structure, a needle-like structure, or a combination thereof on the cathode; and recovering the reduced metal.

In still further aspects, the liquid medium described herein can comprise an aqueous solution, an organic solution, a nonaqueous solution, or a combination thereof. While in still further aspects, the metal comprises lithium, sodium, magnesium, calcium, potassium, barium, or one or more rare earth elements, or alloys thereof.

Also disclosed herein are aspects directed to a system comprising: a) an electrochemical cell comprising an anode and a cathode; wherein the cathode and anode have a longitudinal axis; b) wherein the electrochemical cell is configured to receive a liquid medium comprising metal ions such that the liquid medium is in a fluid communication with the cathode; c) a magnet positioned to form a magnetic field parallel to the longitudinal axis of the cathode and anode such as to induce an azimuthal motion of the liquid medium; and wherein the system is selective to a metal deposition on the cathode.

In still further aspects, disclosed herein also a system comprising: a) an electrochemical cell comprising an anode and a cathode; wherein the cathode and anode have a longitudinal axis; wherein the electrochemical cell is configured to selectively form a reduced metal deposited on the cathode; b) wherein the electrochemical cell is configured to receive a liquid medium comprising metal ions such that the liquid medium is in a fluid communication with the cathode, and c) a member configured continuously to remove the reduced metal from the cathode.

In still further aspects, the electrochemical cell is in electric communication with a voltage source such that a voltage is supplied between the anode and cathode.

In still further aspects, the metal recovered from the cathode can be dendrites, which is a branched pattern of the metal rather than a continuous film or layer(s) of the metal.

Also disclosed herein is a method for selective recovery of a metal from a liquid medium comprising ions of the metal, wherein the method comprises: applying a voltage to an electrochemical cell comprising the liquid medium, an anode and a cathode to induce an electric current flow from the anode to the cathode, wherein the voltage is effective to induce a reduction of the metal ions on the cathode; applying a magnetic field directed orthogonally to the current flow to induce a convectional motion of the liquid medium, thereby moving the liquid medium around the cathode; depositing reduced metal on the cathode; and recovering the reduced metal.

In still further aspects, disclosed herein is a system comprising: a) an electrochemical cell comprising an anode and a cathode; wherein the cathode and anode have a longitudinal axis; b) wherein the electrochemical cell is configured to receive a liquid medium comprising metal ions such that the liquid medium is in fluid communication with the cathode; c) a magnet positioned to form a magnetic field parallel to the longitudinal axis of the cathode and anode, wherein when there is a current flow from the anode to the cathode, the magnetic field is orthogonal to the current flow and induces a convectional motion of the liquid medium; and wherein the system is selective to a metal deposition on the cathode.

Additional advantages will be set forth in part in the description which follows, and in part will be obvious from the description or can be learned by practice of the aspects described below. The advantages described below will be realized and attained by means of the chemical compositions, methods, and combinations thereof, particularly pointed out in the appended claims. It is to be understood that both the foregoing general description and the following detailed description are exemplary and explanatory only and are not restrictive of the invention, as claimed.

BRIEF DESCRIPTION OF FIGURES

The accompanying figures, which are incorporated in and constitute a part of this specification, illustrate several aspects described below.

FIG. 2A shows variations in ionic composition, and FIG. 2B shows the geographic distribution of brines from unconventional domestic resources.

FIG. 3A is an overview schematic of the disclosed technology; FIG. 3B is a schematic of the electrodeposition of $Li^+$ to $Li_s$ at the cathodic collector, where the $Li_s$ is grown volumetrically in the solvent, and the extraction of Li is not limited to the availability of the cathodic surface area; FIG. 3C depicts a schematic of electromagnetic enhancement of $Li^+$ transport to the electro-reduction interface and of $Li_s$ packing by controlled dendrite growth. FIG. 3D shows a schematic of the selectivity of $Li^+$ at the solvent-brine interface to increase the Faradaic efficiency of the carboreduction process in one aspect.

DETAILED DESCRIPTION

Figure 1:
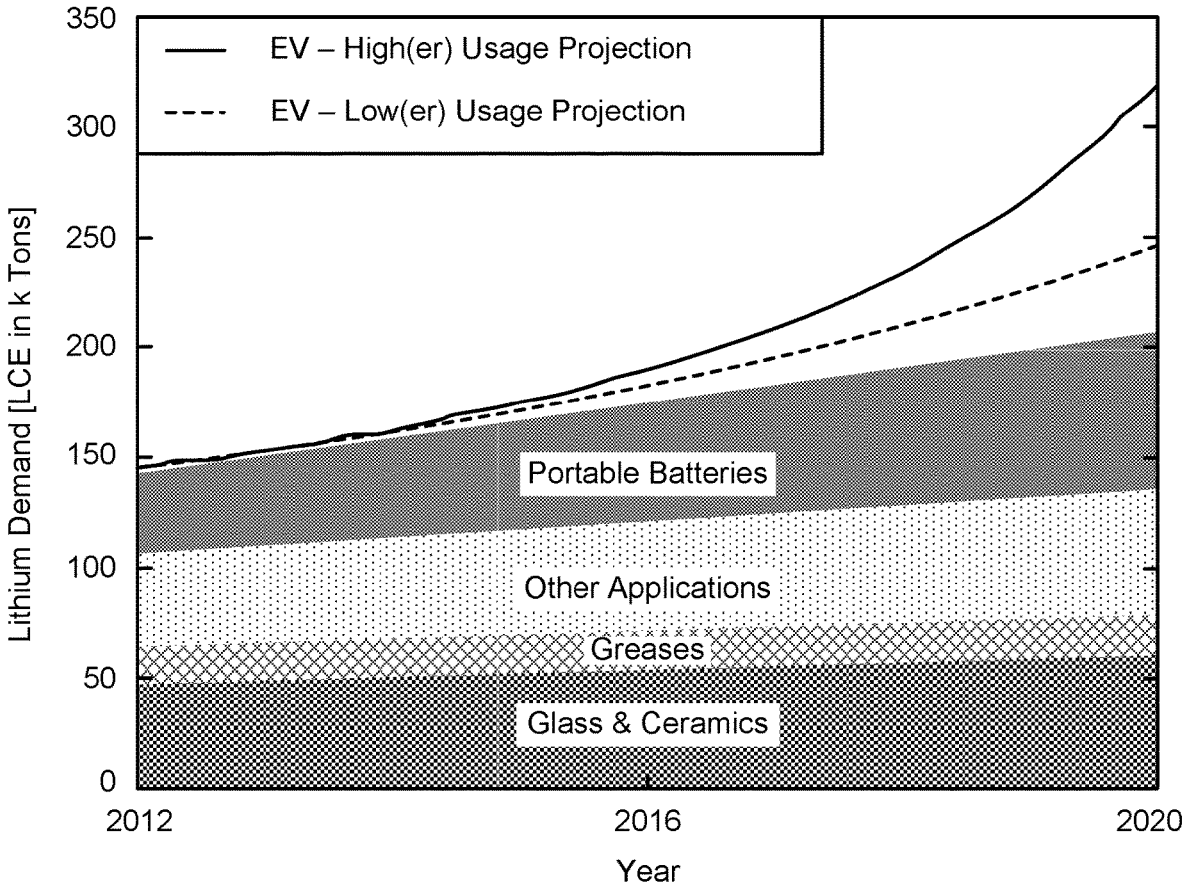
FIG. 1 depicts a lithium demand over the last decade.
Figure 2A:
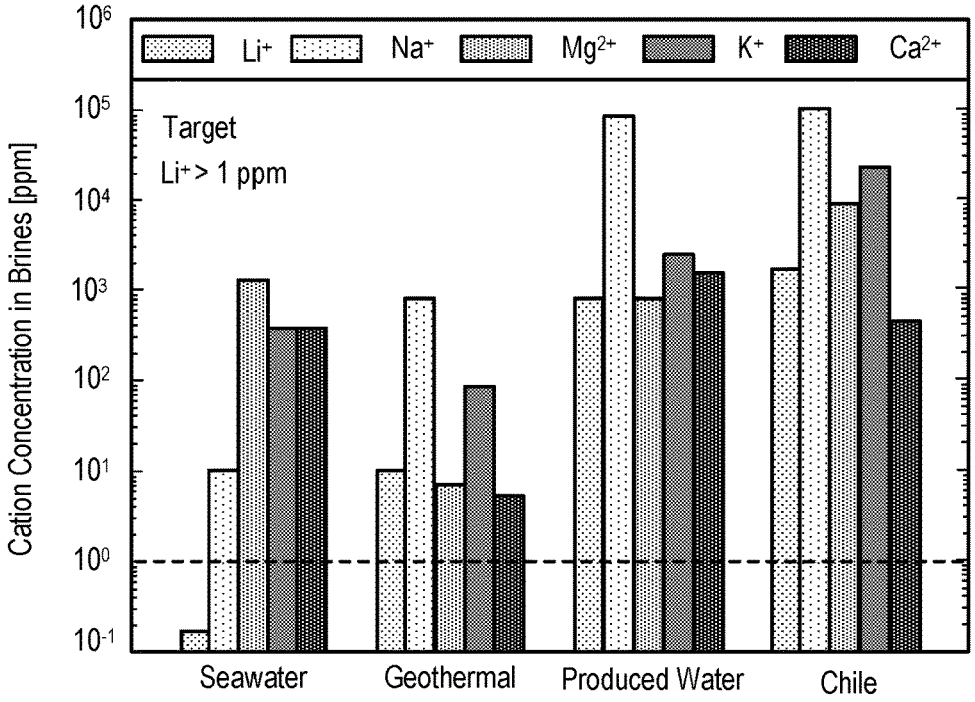
FIGS. 2A and 2B depict a schematic showing lithium availability from domestically produced waters and geothermal brine.
Figure 2B:
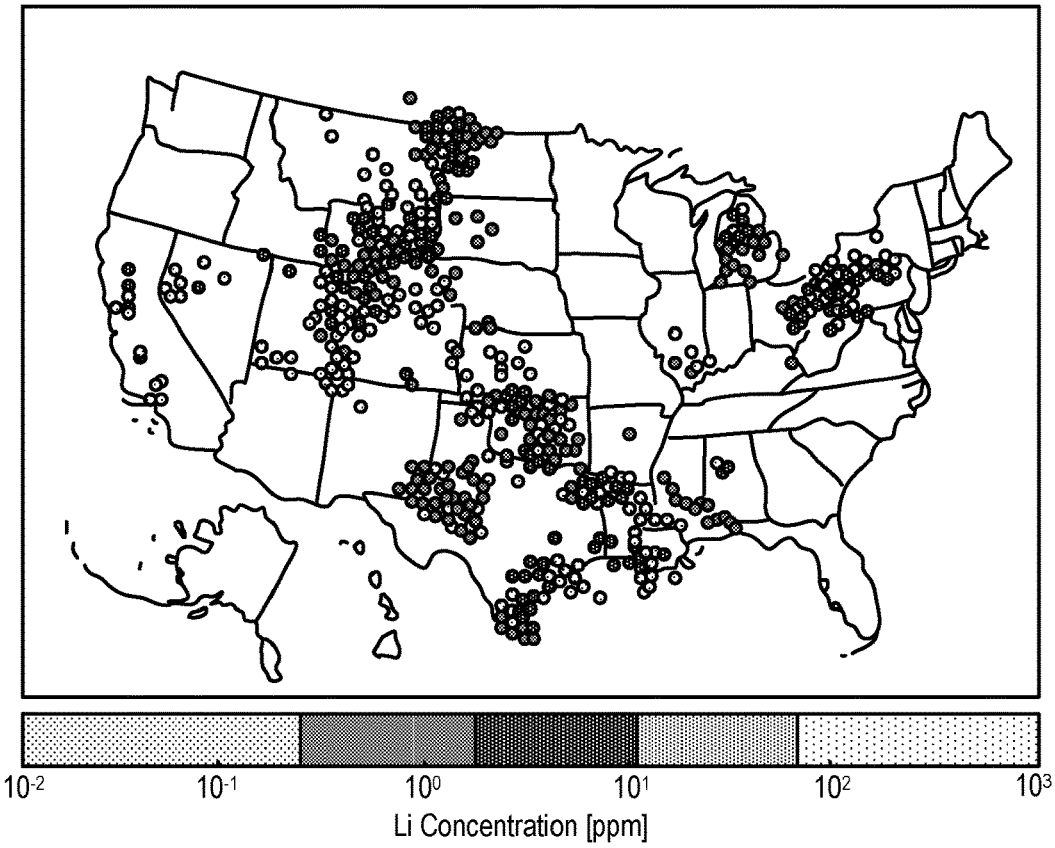

The present invention can be understood more readily by reference to the following detailed description, examples, drawings, and claims, and their previous and following description. However, before the present articles, systems, and/or methods are disclosed and described, it is to be understood that this invention is not limited to the specific or exemplary aspects of articles, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known aspect. To this end, those skilled in the relevant art will recognize and appreciate that many changes can be made to the various aspects of the invention described herein while still obtaining the beneficial results of the present invention. It will also be apparent that some of the desired benefits of the present invention can be obtained by selecting some of the features of the present invention without utilizing other features. Accordingly, those of ordinary skill in the pertinent art will recognize that many modifications and adaptations to the present invention are possible and may even be desirable in certain circumstances and are a part of the present invention. Thus, the following description is again provided as illustrative of the principles of the present invention and not in limitation thereof.

Definitions

It is appreciated that certain features of the disclosure, which are, for clarity, described in the context of separate aspects, can also be provided in combination in a single aspect. Conversely, various features of the disclosure, which are, for brevity, described in the context of a single aspect, can also be provided separately or in any suitable subcombination.

The term "comprising" and variations thereof as used herein is used synonymously with the term "including" and variations thereof and are open, non-limiting terms. Although the terms "comprising" and "including" have been used herein to describe various examples, the terms "consisting essentially of" and "consisting of" can be used in place of "comprising" and "including" to provide for more specific examples of the invention and are also disclosed. Other than in the examples, or where otherwise noted, all numbers expressing quantities of ingredients, reaction conditions, and so forth used in the specification and claims are to be understood at the very least and not as an attempt to limit the application of the doctrine of equivalents to the scope of the claims, to be construed in light of the number of significant digits and ordinary rounding approaches.

As used in the description and the appended claims, the singular forms "a," "an," and "the" include plural referents unless the context clearly dictates otherwise. Thus, for example, a reference to "an electrode" includes two or more such electrodes, a reference to "a metal ion" includes two or more metal ions and the like.

For the terms "for example" and "such as," and grammatical equivalences thereof, the phrase "and without limitation" is understood to follow unless explicitly stated otherwise.

As used herein, the terms "optional" or "optionally" mean that the subsequently described event or circumstance can or cannot occur and that the description includes instances where said event or circumstance occurs and instances where it does not.

Ranges can be expressed herein as from "about" one particular value and/or to "about" another particular value. When such a range is expressed, another aspect includes from the one particular value and/or to the other particular value. Similarly, when values are expressed as approximations, by use of the antecedent "about," it will be understood that the particular value forms another aspect. It should be further understood that the endpoints of each of the ranges are significant both in relation to the other endpoint and independently of the other endpoint. Unless stated otherwise, the term "about" means within 5% (e.g., within 2% or 1%) of the particular value modified by the term "about."

Throughout this disclosure, various aspects of the invention can be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, a description of a range such as from 1 to 6 should be considered to have specifically disclosed subranges such as from 1 to 3, from 1 to 4, from 1 to 5, from 2 to 4, from 2 to 6, from 3 to 6, etc., as well as individual numbers within that range, for example, 1, 2, 2.7, 3, 4, 5, 5.3, 6 and any whole and partial increments therebetween. This applies regardless of the breadth of the range.

As used herein, the term "substantially" means that the subsequently described event or circumstance completely occurs or that the subsequently described event or circumstance generally, typically, or approximately occurs. Still further, the term "substantially" can in some aspects refer to at least about 80%, at least about 85%, at least about 90%, at least about 91%, at least about 92%, at least about 93%, at least about 94%, at least about 95%, at least about 96%, at least about 97%, at least about 98%, at least about 99%, or about 100% of the stated property, component, composition, or other condition for which substantially is used to characterize or otherwise quantify an amount.

While aspects of the present invention can be described and claimed in a particular statutory class, such as the system statutory class, this is for convenience only, and one of ordinary skill in the art will understand that each aspect of the present invention can be described and claimed in any statutory class. Unless otherwise expressly stated, it is in no way intended that any method or aspect set forth herein be construed as requiring that its steps be performed in a specific order. Accordingly, where a method claim does not specifically state in the claims or descriptions that the steps are to be limited to a specific order, it is in no way intended that an order be inferred in any respect. This holds for any possible non-express basis for interpretation, including matters of logic with respect to arrangement of steps or operational flow, plain meaning derived from grammatical organization or punctuation, or the number or type of aspects described in the specification.

The present invention may be understood more readily by reference to the following detailed description of various aspects of the disclosure and the examples included therein and to the Figures and their previous and following description.

Methods

In certain aspects, disclosed herein is a method for selective recovery of a metal from a liquid medium comprising ions of the metal wherein the method comprises: applying a voltage to an electrochemical cell comprising the liquid medium, an anode and a cathode to induce an electric current flow from the anode to the cathode, wherein the voltage is effective to induce a reduction of the metal ions on the cathode; applying a magnetic field directed orthogonally to the current flow to induce an azimuthal motion of the liquid medium, thereby rotating the liquid medium around the cathode; depositing reduced metal on the cathode; and recovering the reduced metal.

It is understood that the liquid medium described herein can be any medium that comprises the desired metal ions for the metal deposition and recovery. In some aspects, the liquid medium comprises an aqueous solution, an organic solution, a nonaqueous solution, or a combination thereof. In certain aspects, the liquid medium is an aqueous solution. While in other aspects, the liquid medium is an organic solution. In yet further aspects, the liquid medium is a mixture (a combination of the aqueous solution and organic solution). It is understood that if the mixture of the aqueous and organic solutions is present in the liquid medium, the aqueous and organic solutions can be substantially miscible or immiscible, or at least partially miscible. It is understood that the aqueous and organic solutions can be present in any ratio relative to each other.

In the aspects disclosed herein, the metals that can be deposited by the disclosed methods comprise any metals that form soluble ions in the disclosed herein liquid medium and can undergo an electrochemical reduction in the electrochemical cells. For example, the metal deposited by the disclosed herein methods can comprise lithium, sodium, magnesium, calcium, potassium, barium, or one or more rare earth elements, or alloys thereof. In some exemplary and unlimiting aspects, the metals deposited by the disclosed methods are one or more rare earth elements. In yet other exemplary and unlimiting aspects, the metals deposited by the disclosed methods are lithium metals.

It is understood that in aspects where the metal is deposited on the electrode, the liquid medium comprises ions of such a metal. For example, in aspects where sodium is electrodeposited, the liquid medium comprises sodium ions. In aspects where, for example, rare earth elements are electrodeposited, the liquid medium comprises ions of the rare earth elements. Yet, in aspects where lithium metals are deposited, the liquid medium used in the disclosed methods comprises lithium ions. Similarly, if any other metal ions are to be deposited, the liquid medium comprises at least some amount of these metal ions. It is further understood, however, that the liquid medium can comprise one or more other ions, for example, the liquid medium can comprise ions of one or more of lithium, sodium, magnesium, calcium, potassium, barium, or one or more rare earth elements, or any combination thereof. In such aspects, the methods operating conditions are chosen to selectively deposit the desired metal as discussed below.

Figure 6:
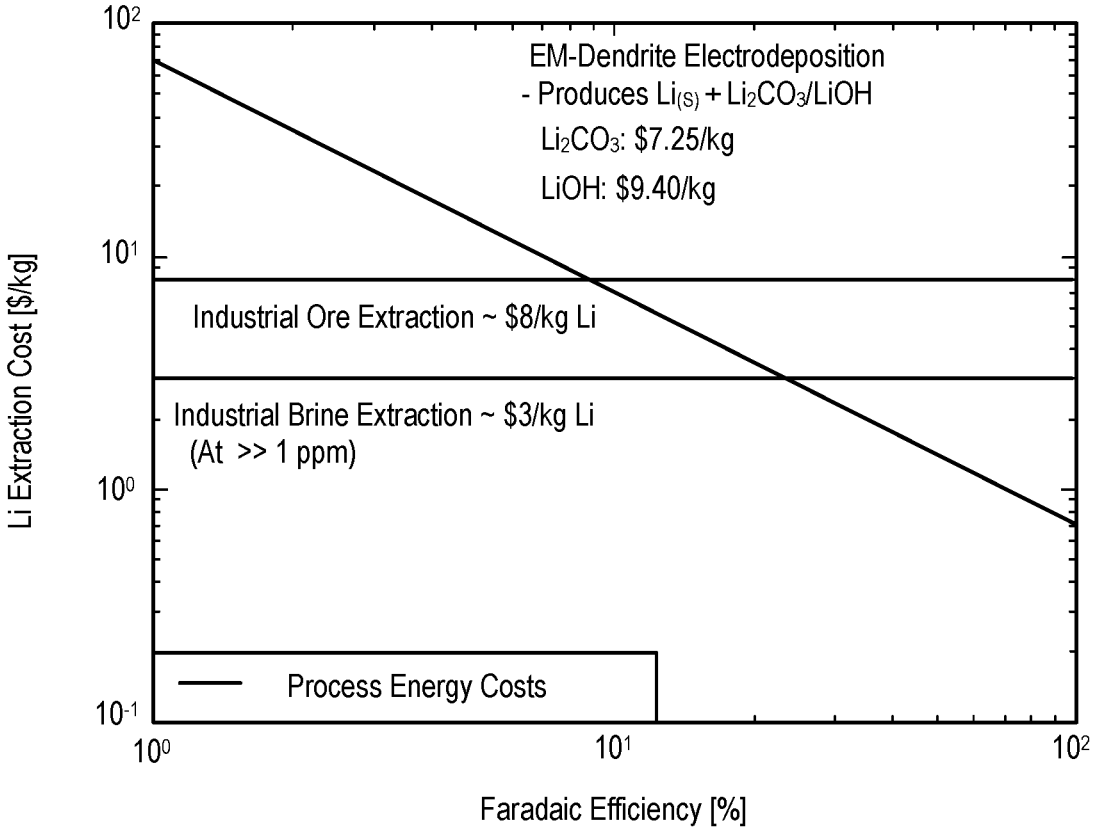
FIG. 6 depicts the economic feasibility of the disclosed $Li^+$ to $Li_s$ methods. The electrical costs of the process are plotted as a function of the Faradaic efficiency, a measure of selectivity, assuming industrial pricing of $0.06/kW-hr.

In some aspects, selectivity can be understood as the efficiency required for energetic breakeven for a specific feedstock (FIG. 6). In such aspects, the higher the concentration of metal ions of interest, the lower the reduction efficiency that will be needed to be "selective."

In still further aspects, the metal ions present in the liquid medium can be present in an amount of less than about 2,000 ppm.

The disclosed methods allow deposition of solid metals that comprise less than about 2,000 ppm of metal ions, including exemplary values of less than about 1,800 ppm, less than bout 1,500 ppm, less than about 1,200 ppm, less than about 1,000 ppm, less than about 800 ppm, less than about 500 ppm, less than about 200 ppm, less than about 100 ppm, less than about 80 ppm, less than about 50 ppm, less than about 10 ppm, less than about 5 ppm, or even less than about 1 ppm.

For example, when lithium metal is deposited from the liquid medium, such a solution can comprise less than about 2,000 ppm of lithium ions, including exemplary values of less than about 1,800 ppm, less than bout 1,500 ppm, less than about 1,200 ppm, less than about 1,000 ppm, less than about 800 ppm, less than about 500 ppm, less than about 200 ppm, less than about 100 ppm, less than about 80 ppm, less than about 50 ppm, less than about 10 ppm, less than about 5 ppm, or even less than about 1 ppm of lithium ions. In yet other exemplary aspects, the disclosed methods allow deposition of lithium metals, for example, or other desired metals, from the liquid medium that comprise from about 0.5 ppm to about 2,000 ppm of lithium ions (or other desired metals, as described above), including exemplary values of about 1 ppm, about 5 ppm, about 10 ppm, about 50 ppm, about 100 ppm, about 150 ppm, about 200 ppm, about 500 ppm, about 800 ppm, about 1,000 ppm, about 1,200 ppm, about 1,500 ppm, and about 1,800 ppm.

However, it is also understood that these metal concentrations in the liquid medium are not limiting. The disclosed methods allow the deposition of the solid metals from the liquid medium with metal ions concentration higher than about 2,000 ppm, higher than about 5,000, or higher than 10,000 ppm. In further aspects, the maximum limit of the metal ions present in the liquid medium is not limited. In exemplary aspects where the lithium metal is deposited, the liquid medium can also have lithium-ion concentrations higher than about 2,000 ppm, higher than about 5,000 ppm, or higher than 10,000 ppm. In still further aspects, the maximum limit of the lithium ions present in the liquid medium is not limited.

It is understood that the metal ions can have any counter anions that form a neutral compound with the metal ion. In some exemplary aspects where the lithium ions are present, such lithium ions can have any counter anions that can form a neutral compound with the lithium-ion. Likewise, when other metal ions are present in addition to lithium, they too can have any counterions that form a neutral compound with the metal ion. It is understood, however, that the use of lithium ions herein is only illustrative and any of the disclosed above metal ions, and their counteranions can be present in the liquid medium. In certain exemplary and unlimiting aspects, the counter anions can comprise halides, carbonates, sulfates, nitrates, nitrites, phosphates, and the like. It is understood that at least some amount of lithium ions (or any other metal ions of interest) is substantially dissolved in the liquid medium.

Various technologies are currently used to produce solid metals from the liquid medium, such as an aqueous solution. Some of these methods include prolonged extraction processes, chelating processes, or evaporation. For example, and without limitations, currently used technologies for the production of Li metals first produce lithium carbonate ($Li_2CO_3$) and/or lithium hydroxide (LiOH) from Li-rich brines through evaporation and precipitation and then reduce $Li_2CO_3$ and LiOH to the lithium metal. Baseline evaporative technology is known to be time-consuming (it can take almost 18 months to vaporize water), site-specific (requires large areas of land with high evaporation rates, low elevation variability, and low rainfall/humidity), has low recovery factors due to $Li^+$ loss during precipitation and produces a low purity product due to a lack of selectivity during evaporation. Similar challenges exist for the recovery of other alkali and alkaline-earth metals.

The methods disclosed herein allow a direct reduction of the metal of interest without a need for time-consuming and often expansive multi-step processes. As discussed above, any metals that can be reduced in the disclosed electrochemical cell can be obtained by the disclosed methods. For example, in some aspects, the disclosed methods directly reduce lithium ions from the liquid medium to metallic lithium without a need for expansive and prolonged evaporation techniques. Yet, in other aspects, the disclosed methods can also allow a direct reduction of rare earth elements, for example.

In aspects where the lithium metal is deposited, the methods of the current disclosure exploit a longstanding problem that was plaguing the lithium battery field for decades—the formation of lithium dendrites during the battery charge. In such exemplary aspects, the lithium metal deposited on the cathode comprises a plurality of dendrites. It is understood, however, that if other metals are deposited by the disclosed methods, those metals do not have to form dendrites. In some aspects, the growth of the deposited metal is diffusion-limited, and thus dendrites can be formed. In yet other aspects, the growth of the deposited metal can be reaction rate limited, it can have a linear growth rate, and the like.

In still further aspects, the reduced metal obtained by the disclosed herein methods can form a plurality of fractal dendrites, a mossy structure, a needle-like structure, or a combination thereof on the cathode.

In still further aspects, the lithium metal (or any other metal obtained by the disclosed methods) can be used as obtained. In such exemplary aspects, no additional purifications or modifications can be necessary. For example, in some aspects, if the lithium metal is deposited by the disclosed herein methods, it can be directly used as an anode material in the next generation of lithium batteries. Any other suitable uses of the deposited metals are also possible. In still further aspects, the metal deposited on the cathode can be recovered and further purified if needed.

It is understood that in the methods disclosed herein, it is possible to obtain the reduced metal of various purity and throughput as disclosed below.

In some aspects, the cathode and anode have the same or different geometrical shapes. While in still further aspects, the cathode can be a rotating electrode.

In still further aspects, the disclosed methods comprise an electrochemical cell where an anode and a cathode are disposed concentrically such that the anode is positioned around the cathode at a radial distance. In still further aspects, the radial distance can be chosen to maximize the yield of the metal deposition. In some exemplary and unlimiting aspects, the radial distance between the anode and cathode can be from about up to about 10 cm, including exemplary values of about 1 cm, about 2 cm, about 3 cm, about 4 cm, about 5 cm, about 6 cm, about 7 cm, about 8 cm, and about 9 cm. However, it is also understood that in some aspects, where the method is scaled to obtain larger amounts of the reduced metal, the radial distance can be more than 10 cm, more than 15 cm, or even more than 20 cm. It is further understood that the upper limit of the radial distance between the two electrodes can be determined by the current density. In still further aspects, the upper limit of the radial distance between the two electrodes can also be determined by the economic viability of the method.

Also disclosed are aspects where the electrochemical cell does not necessarily have a radial configuration of the electrodes. In some aspects, the electrochemical cell can have a linear configuration. In such aspects, the method can comprise applying a voltage to an electrochemical cell comprising the liquid medium, an anode and a cathode to induce an electric current flow from the anode to the cathode, wherein the voltage is effective to induce a reduction of the metal ions on the cathode; applying a magnetic field directed orthogonally to the current flow to induce a convectional motion of the liquid medium, thereby moving the liquid medium around the cathode; depositing reduced metal on the cathode; and recovering the reduced metal. In such aspects, instead of inducing the azimuthal motion of the liquid medium, the magnetic field can induce the convectional motion of the liquid medium around the cathode. In still further aspects, the linear distance between the anode and cathode can be from about up to about 10 cm, including exemplary values of about 1 cm, about 2 cm, about 3 cm, about 4 cm, about 5 cm, about 6 cm, about 7 cm, about 8 cm, and about 9 cm. However, it is also understood that in some aspects, where the method is scaled to obtain larger amounts of the reduced metal, the linear distance can be more than 10 cm, more than 15 cm, or even more than 20 cm. It is further understood that the upper limit of the linear distance between the two electrodes can be determined by the current density. In still further aspects, the upper limit of the linear distance between the two electrodes can also be determined by the economic viability of the method.

In still further aspects, the anode and cathode electrodes can have a suitable size and shape for the disclosed application and can be made of any suitable materials that can allow efficient electro-reduction of the desired metals. In some aspects, the cathode can comprise copper, carbon, graphite, sodium, potassium, or lithium. In still further aspects, the cathode can comprise metal oxides such as $\lambda$-$MnO_2$ and $LiMn_2O_4$ spinel, olivine $LiFePO_4$ and $FePO_4$, layered $LiNiMnO_2$, and coated electrodes. It is understood that in some aspects, the cathode can comprise the same metal that is the deposited metal.

In still further aspects, the electrodes can have any desired geometry that allows a crossed current flow. In still further aspects, if the magnet is used, the electrodes can have any geometry that allows a) radial current flow and axial magnetic field or b) axial current flow and radial magnetic field. In some exemplary aspects, if a) is desired, the electrodes can have a concentric geometry and/or can be hollow. In other exemplary aspects, if b) is desired, the electrodes can have a circular plate shape. In such exemplary and unlimiting aspects, two circular plates can be disposed above each other. In still further aspects, the plates can also be rotating electrodes.

In yet still further aspects, when the magnet is used, the electrodes also can have any geometry that would allow the formation of the orthogonal magnetic field to the current flow. It is understood that the electrodes do not have to be circular.

It is also understood that any of the disclosed herein cathodes can also be rotated to increase the transport rates of metal ions to the cathode. In aspects where the cathode electrode is configured to be rotated, the cathode can also be in electrical communication with a motor.

In still further aspects, the cathode can have a surface area efficient to provide the desired metal deposition.

In certain aspects where the cathode, for example, is a rod, the rod can have a diameter that would provide the desired surface area and the current density needed for the deposition of the metal of interest. In still further aspects, the anode electrode can comprise carbon or platinum. In some exemplary aspects, and as disclosed herein, the anode electrode can comprise a hollow cylinder. In such aspects, the cathode electrode is positioned within the anode cylinder such that it is substantially centered relative to the surrounding anode electrode. It is understood that the specific geometry and size of each of the electrodes can be adjusted based on the deposited metal, the amount of metal to be deposited, and the like.

In still further aspects, the applied voltage directs an electric current from the anode to the cathode orthogonally to the longitudinal axis of the cathode/anode to form a radial current flow such that the current flow is orthogonal to the magnetic field.

In still further aspects, the applied voltage can be in a range from about −5V to about 5 V, including exemplary values of about −4 V, about −3 V, about −2 V, about −1 V, about 1 V, about 2 V, about 3 V, and about 4 V. It is understood, however, that this range is exemplary, and any voltage range within the redox potential of the wanted ionic species can be utilized. In still further aspects, the voltage can be any voltage required to cause the metal of interest to be reduced and deposited on the cathode.

In still further aspects, the electric current can be from about 0.1 mA to about 1 A, including exemplary values of about 0.5 mA, about 1 mA, about 5 mA, about 10 mA, about 20 mA, about 30 mA, about 40 mA, about 50 mA, about 60 mA, about 70 mA, about 100 mA, about 200 mA, about 300 mA, about 400 mA, about 500 mA, about 600 mA, about 700 mA, about 800 mA, and about 900 mA. It is understood that in some aspects, the current can also be above 1 A, for example, and without limitations, about 1.5 A, about 2 A, or about 3 A. In yet still further aspects, the magnetic field is applied from about 1 mT to about 0.2 T, including exemplary values of about 5 mT, about 10 mT, about 20 mT, about 30 mT, about 40 mT, about 50 mT, about 60 mT, about 70 mT, about 80 mT, about 90 mT, about 100 mT, about 125 mT, about 150 mT, and about 175 mT. It is understood that the value of the magnetic field can be the same during the duration of the electrodeposition of the metal, or it can vary depending on the deposition yield, level of electrocentrifugation, intensity (and direction) of rotation of the liquid medium.

Figure 3A:
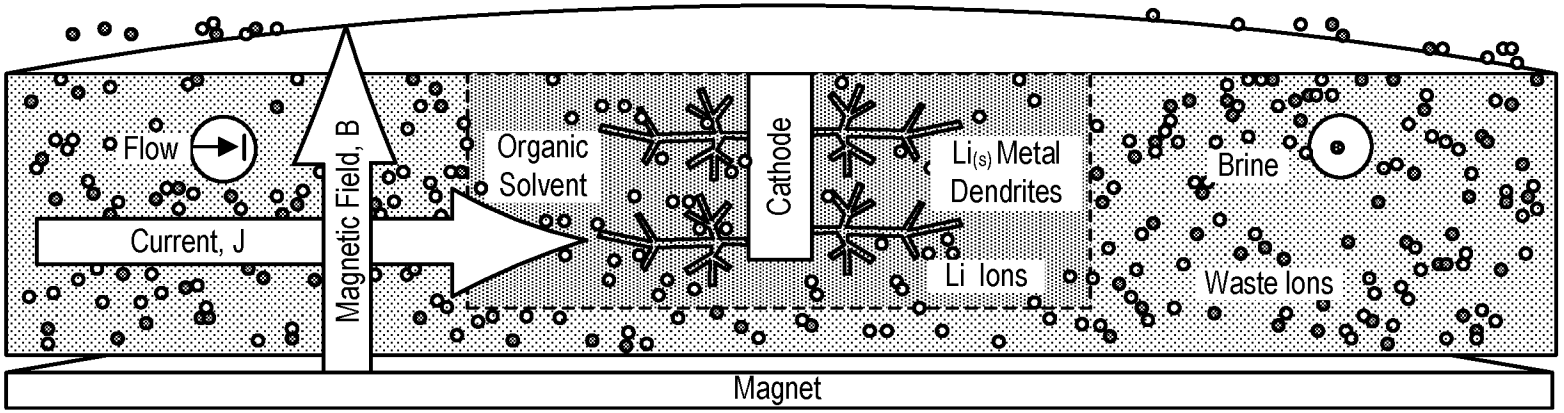
FIGS. 3A-3D depict a schematic of the direct conversion of Li-ions to Li-metal through electromagnetically-controlled dendritic electrodeposition as disclosed in one aspect.
Figure 3B:
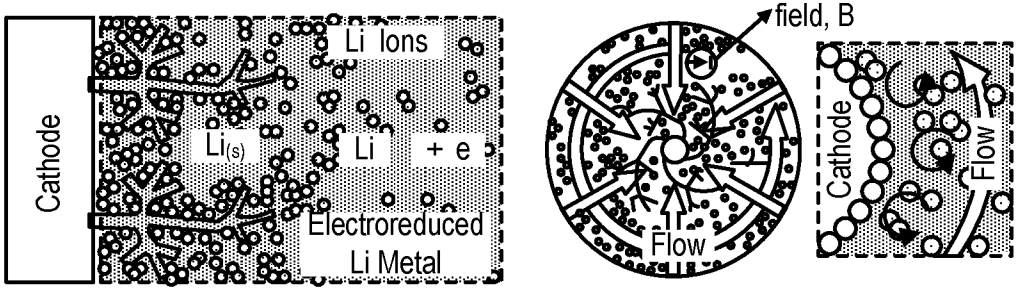

In certain aspects, the methods disclosed herein utilize electromagnetic force to drive the desired metal ions towards the cathode for selective deposition. For example, as schematically shown in the FIG. 3A, $Li^+$ ions are driven towards the cathode by the electromagnetic force. As a result, more $Li^+$ ions arrive at the cathode and get reduced to $Li_s$ metal through controlled dendritic electrodeposition (FIG. 3B).

Figure 3C:
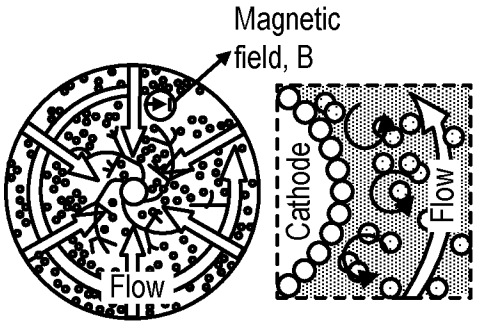

In certain aspects, the magnetic field applied to the electrochemical cell can induce continuous advection of the liquid medium. Without wishing to be bound to any theory, the methods of the current disclosure use electromagnetic forces to enhance the transport of the ions to be deposited to the cathode surface. For example, electromagnetic forces enhance $Li^+$ transport to the cathode surface through electromagnetically-driven advection (FIG. 3C). In aspects where the deposited metal forms dendrites, such as, for example, Li metal, the disclosed methods allow increasing the packing density of these dendrites on the cathode surface. In some aspects, the electromagnetically-induced advection can increase the transport and rate of deposition of the electrode surface. Thus, for example, even if the desired metal does not form dendrites upon reduction, the solid metal formed on the cathode can also have improved the packing density of the metal atoms.

In yet further aspects, the use of the electromagnetically driven advection can also improve cation partitioning in the liquid medium based on the cation charge, size, and/or mass.

In some aspects, the liquid medium can comprise additional ions, e.g., additional metal ions that are not desired to be deposited at the cathode as solid metals. For example, and without limitations, the liquid medium used in the disclosed methods can also comprise ions of one or more of lithium, sodium, magnesium, potassium, calcium, potassium, barium, or one or more rare earth elements ions. The disclosed methods, however, can be tuned to improve deposition selectivity to the specific cation to obtain the desired solid metal. For example, when the methods are directed to the deposition of lithium metal, these methods are selective to lithium over other cations present in the liquid medium.

Again, and as discussed in detail above, it is understood that an efficient reduction of metal ions on the cathode surface is dependent on the transport of metal ions to the electrode. For example, rapid and efficient $Li^+$ reduction requires maximizing the transport of $Li^+$ to electrode surfaces, maximizing the surface area available for electro-reduction, and improving ionic selectivity. Similar requirements exist for other metals that can be deposited by the disclosed herein methods. Conventional electroplating techniques are amenable to electro-reduction but are slow due to constraints in the reaction surface area and the delivery of metal ions, such as, for example, $Li^+$.

As discussed above, in certain aspects, when the deposited metal is, for example, lithium, the lithium metal is deposited as a plurality of fractal dendrites, a mossy structure, a needle-like structure, or a combination thereof on the cathode.

For example, experiments using $LiPH_6$ in a 1:1 mixture of ethylene carbonate (EC) and dimethyl carbonate (DMC) show the growth of a dense moss-like Li deposit on the electrode surface during the early stages of reduction. At the microscale, the moss-like Li growth is composed of randomly oriented whiskers, consistent with the structure expected for reaction-limited deposition. These dendrites continue to grow during charge/discharge cycles of the lithium batteries and eventually can cause shortening and failure of the battery.

In aspects of the current disclosure, however, it was found that while the dendritic growth of lithium is undesirable in the lithium batteries, it, in fact, allows forming of metallic lithium at low ionic concentration, and thus, allows the recovery of lithium ions from the solutions that previously were considered as unusable due to the complex processing steps required for lithium recycling. It is understood that other metals that can form a plurality of dendrites can be deposited by the disclosed herein methods. It is also understood that the metals that can be deposited by the disclosed herein methods do not have to form dendrites.

In aspects where dendrites are formed, without wishing to be bound by any theory, it is assumed that the dendritic metal electrodeposits can be dictated by diffusion-limited aggregation with fractal dimensionalities D~2.4 in three dimensional systems (Sander, L. M. "Fractal Growth Process," *Nature,* 1986, 322 (6082), 789-793). In such aspects, the surface area (SA) of the cathode electrode is available for reduction scales with the volume of the deposit, V, by $SA \sim V^{2.4}$. Without wishing to be bound by any theory, it was found that the dendritic growths increase the surface area to volume ratio, thereby increasing the reaction surface area and metal ions, for example, $Li^+$ access to enable rapid extraction from the liquid medium, such as aqueous solutions.

It is understood that generally, the ionic selectivity and diffusion-limited transport constrain the energy efficiency and extraction rate in the electrochemical processes. These issues are at least partially resolved by using the magnetic field in the disclosed herein methods steps. More specifically, in some aspects, the magnetic field can enhance the transport of metal ions, for example, and without limitation, Li ions to the cathode surface and to enhance the rate of the dendritic reduction, as schematically shown in FIG. 3C. As disclosed above, the use of concentric electrodes allows the creation of a radial current flow $\vec{J}_l$. The magnetic field is applied in the axial direction, $\vec{B}$, induces an azimuthal Lorentz force, $\vec{F}_L=\vec{J}_l\times\vec{B}$, that acts on the radial ion currents. The azimuthal motion results in a bulk rotation of the aqueous solution. In such aspects, the resulted rotation enhances the diffusion-limited transport of ions, for example, $Li^+$ ions (or other metal ions to be deposited as a solid metal) to the cathode by increasing ionic advection near the reaction interface by removing reaction products from the reaction sites. In further aspects, the resulted rotations can also increase the selectivity of $Li^+$ ions (or other metal ions, depending on the application) near the cathode by forming an electromagnetic centrifuge. In such exemplary aspects, the sustained ion currents can drive rotational centrifugation to selectively partition ions with large mass-to-charge ratios towards the anode and ions with small mass-to-charge ratios closer to the cathode. In the aspects where the desired deposited metal is lithium metal, for example, any mass-to-charge ratios higher than $1\times10^{-4}$ g/C can be directed towards the anode. In such exemplary and unlimiting aspects, for example, since lithium has $m/q_{Li+}\sim7.19\times10^{-5}$ g/C it is directed towards the cathode, while sodium having $m/q_{Na+}\sim2.38\times10^{-4}$ g/C, magnesium having $m/q_{Mg2+}\sim1.24\times10^{-4}$ g/C, calcium having $m/q_{Ca2+}\sim2.08\times10^{-4}$ g/C, and potassium having $m/q_{K+}\sim4.05\times10^{-4}$ g/C are directed towards the anode. It is understood that centrifugal portioning can be tuned depending on the desired selectivity.

In still further aspects, the electrochemical cell as disclosed herein can further comprise a further solvent that is substantially immiscible with the liquid medium and is in flow communication with the cathode. In some aspects, the further solvent is an organic solvent that is selective to the metal to be deposited. It is understood that the organic solvent can be a solvent that is compatible with the desired metal to be deposited. In certain aspects where the deposited metal is lithium, the organic solvent is selective to lithium ions or specifically selective to sodium ions or one or more rare earth metal ions.

Figure 3D:
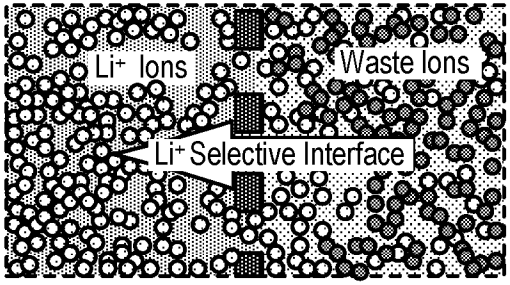

In certain aspects, the organic solvent can be added to prevent exothermic reactions between the deposited metal, for example, solid Li and water present in the aqueous solutions. It is known that lithium reacts violently with water, and for safety reasons and reasons of increasing Faradaic efficiency, in certain aspects, an organic solvent and/or a nonaqueous solvent that are immiscible with the aqueous solution can be added (FIG. 3D). Suitable nonaqueous and/or organic solvents that can be used for this purpose are available in the art. In certain exemplary and unlimiting aspects, the organic solvent can comprise dimethyl carbonate, diethyl carbonate, ethyl methyl carbonate, polyoxylene, propylene carbonate, fluoroethylene carbonate, ethylene carbonate, room-temperature ionic liquids, or any combination thereof. In yet other aspects, the organic solvent can comprise one or more of vinylene carbonate, tetrahydrofuran, 2-propynyl methanesulfonate, 1,3-propylene sulfite, 1,2-propyleneglycol sulfite, adiponitrile, allyl methyl sulfone, 1,4-Di-tert-butyl-2,5-bis(2-methoxyethoxy)benzene, 2,2-dimethyl-3,6,9,12-tetraoxa-2-silatridecane, ethylene sulfite, phenylcycloxehane, 1,3-propanesultone, and the like. Again, it is understood that the specific solvent can be chosen such that it is selective to the metal to be deposited. In aspects where lithium metal is deposited, the organic solvent can comprise any of the mentioned above solvents or other solvents commonly used in lithium-based batteries.

In further aspects, various additives can be added to the organic solvent to improve solvent selectivity. The specific additives can be chosen based on the metal to be deposited. For example, in some aspects, the additives are lithium selectivity improving additives. Such additives can comprise chelating agents, titanium oxide, or any combination thereof.

In still further aspects, the further solvent is designed to have a density that matches a density of the liquid medium. In some aspects, such a match of densities stabilizes the liquid medium-further solvent interface. For example, in aspects where the further solvent is an organic solvent and the liquid medium comprises an aqueous solution, the organic solvent can have a density that is substantially similar to a density of the aqueous solution.

In still further aspects, the methods disclosed herein can comprise a selective partitioning of the desired metal ions from other ions present in the liquid medium. In certain aspects, a multi-layered approach to partitioning can be utilized. For example, in some aspects and as disclosed above, the use of further solvents specifically chosen to have higher selectivity to the specific metal ion. For example, the organic solvent is chosen to be specific to Li ions and to allow the transfer of Li ions from the liquid medium to the further solvent (for example, if the liquid medium is an aqueous solution and the further solvent is an organic solvent, an organic-aqueous phase extraction can be utilized) without transfer of other ions that can be present in the liquid medium.

In yet other aspects, the partitioning can be achieved by adding a separator to the electrochemical cell. As used herein, the term "separator" refers to any physical entity that allows separation between at least two metal ions. For example, in some aspects, the separator is a membrane. Yet, in other aspects, the separator is a filter. In some aspects, the separator can separate two or more metal ions based on the ion size, ion mass, ion charge, ion affinity, or a combination thereof.

In some aspects, the partitioning is only achieved by the use of the separator without the use of the disclosed above further solvent. While in other aspects, both the separator and the further solvent are present to provide the desired partitioning of the metal ions. It is understood that the disclosed herein separators, and/or further solvents, and/or electromagnetic centrifugation allow increasing the concentration of the metal ions around the cathode.

It is understood that in some aspects, the presence of the further solvent and/or the separator can be determined by the desired deposition throughput and the desired purity of the reduced metal. It is understood that, in some aspects, adding additional layers of partitioning and selectivity can reduce the throughput of the method but increase the purity of the reduced metal.

In some aspects, the separator can be an ion-selective membrane. For example, when lithium metal is deposited, the separator can be a lithium ion-selective membrane. Again, as discussed above, the separator can be used alone or along with the further solvent. In such exemplary aspects, the separator can partition the further solvent from the liquid medium such that it allows a transfer of only desired ions. For example, in aspects where the lithium metal is deposited, the separator is substantially permeable to lithium ions, and therefore it allows the transfer of lithium ions from the liquid medium to the further solvent.

The separators used herein can have a thickness that would allow the desired partitioning. For example, the separators can be made to have a thickness from the sub-micron regime to tens of microns. Preferably, the membranes can be from about 0.5 microns to about 30 microns thick, including exemplary values of from about 0.5 microns to about 15 microns, from about 15 microns to about 30 microns, from about 0.5 microns to about 10 microns, from about 10 microns to about 20 microns, from about 20 microns to about 30 microns, from about 1 micron to about 30 microns, from about 0.5 microns to about 25 microns, or from about 1 to about 25 microns.

Again, the separator can be specifically selective to the desired metal to be deposited. In certain exemplary and unlimiting aspects, the separator can be selective for lithium over one or more sodium, potassium, magnesium, and/or calcium. In addition, and as discussed in detail above, the use of electromagnetic centrifugation further improves the selectivity of transport of metal ions, for example, lithium ions, towards the cathode. It is understood that each of these multi-layered approaches can be used independently or serialized or used simultaneously to tune selectivity for liquid medium with compositional variations.

In some aspects, and as discussed above, the partitioning of the lithium ions from the liquid medium comprising the aqueous solutions can be done by using separation. Separation of Li ions, for example, can be done due to its relatively small ionic radius ($r_{Li+}$~182 pm) in comparison to other cationic species that can be present in the aqueous solutions described in this disclosure (e.g., $r_{Na+}$~227 pm, $r_{Ca2+}$~231 pm, $r_{K+}$~280 pm). The ion-selective membranes or other physical separators that can be useful for the disclosed purpose are available in the art. In certain aspects, the separator comprises a metal-organic framework (MOF), polyethylene terephthalate membrane, cellulose acetate butyrate), polysulfone, polybenzimidazole, poly(amideimide), polyethersulfone, polyphenylsulfone, polyimide, polyacrylonitile, poly(ethylene oxide), poly(ether ether ketone) (PEEK), poly(vinylidene fluoride), poly(ethylene ch lorotrifluoroethylene), polycarbonate, polystyrene, poly(ether-block-amide), acrylonitrile butadiene styrene, bisphonenolsulfone, carbon nanotubes, and derivatives and combinations thereof. In still further aspects, the MOFs can be selected from the group consisting of UiO-66, UiO-66-(COOH)2, UiO-66-SO3H, UiO-Br, and UiO-66-NH2, and the like. It was shown that membranes constructed of the metal-organic framework (MOFs) and carbon nanotubes demonstrate selective transport for Li-ions. The membrane (wall) channel size, charge, and morphology can be tuned to further increase the selectivity of the membrane for lithium ion or any other ion of interest transport. However, in certain aspects, some additional ions having a small radius can also pass through a size-based ion-selective membrane. For example, the $Mg^{2+}$ radius is relatively small $r_{Mg2a+}$~173 pm, and therefore it can pass through the membrane together with $Li^{+}$. To avoid magnesium contamination in such aspects, additional partitioning methods can be used. For example, the use of membranes and electromagnetic centrifugation (separation based on the mass-to-charge ratio) can allow the separation of magnesium from lithium.

Some exemplary and unlimiting membranes can comprise MOFs types of membranes (e.g., ZIF-8) or carbon nanotubes. Existing off-the-shelf membranes such as pure and iron-doped lithium aluminum double hydroxide chloride ($LiCl.2Al_{1-x}Fe_x(OH)_3.nH_2O$) (LDH) sorbents in a polymer matrix developed by the Critical Materials Institute, or Li—Ti—O (LTO) based membranes can be used.

In still further aspects, and as discussed in detail above, the use of further solvents can improve the selectivity of metal ions transport towards the cathode. In certain aspects, the density of the further solvent, for example, an organic solvent, needs to be substantially identical to the density of the liquid medium, for example, an aqueous solution. However, if the density of organic solvent is different from the aqueous solution, the difference can be overcome by imposing capillary pressure. In such aspects, the separator can form a capillary pressure. The capillary pressure can be formed with a porous interface. For example, membranes can be chosen to have a mesh size to compensate for the density differences (mesh size can be measured as $D \sim \gamma/\Delta\rho$, where $\gamma$ is an interfacial tension and $\Delta\rho$ is the density difference between the aqueous solution and the solvent).

It is understood that, in some aspects, also disclosed herein are methods using only a further solvent without the presence of the magnetic field and/or a physical separator to deposit the desired metal. In yet other aspects, also disclosed are methods using only a physical separator without the presence of the magnetic field and/or a further solvent to deposit the desired metal. Also disclosed are methods using only the presence of the magnetic field without the presence of a physical separator and/or a further solvent to deposit the desired metal. In yet other aspects, any two of the disclosed enhancements can be present. Still further disclosed are methods utilizing all enhancements, such as the presence of the magnetic field, the presence of the further solvent, and the presence of the physical separator.

In still further aspects, and as disclosed above, the deposited metal can be recovered continuously in situ. In some aspects, the methods disclosed above can be batch methods. While in other aspects, the methods can be continuous. In continuous methods, the liquid medium can be continuously supplied to the electrochemical cell and the deposited metal removed from the cathode surface.

In the methods disclosed herein, the liquid medium can be a solution comprising the desired amount of the metal ions that are to be deposited. In certain aspects, the liquid medium is a geothermal brine, produced waters, wastewater, recycled batteries' electrolytes, seawater, desalination brines, aquifer brines, or any combination thereof. In yet other aspects, any geofluids can be used as the liquid medium of the current disclosure. For example, when the liquid medium is an aqueous solution, it can also comprise processing waters from the recycling process or any other solutions having the desired metal ions. It is understood that the aqueous solution can have acidic pH or basic pH, or it can be neutral. In some aspects, the pH of the aqueous solution is lower than 7. While in other aspects, the pH of the aqueous solution is higher than 7. It is also understood that the aqueous solution can be used as they are obtained or to forego other processes prior to the electrodeposition. For example, in some aspects, the brine solution can be used as-it for the electrodeposition. While in other aspects, it can be first filtered to remove large undissolved components and contaminants.

In still further aspects, the solid metal purity can be up to 100%, for example, deposited solid metal can have purity greater than about 20% to up to 100%, including exemplary values of about 25%, about 30%, about 35%, about 40%, about 45%, about 50%, about 55%, about 60%, about 65%, about 70%, about 75%, about 80%, about 85%, about 90%, about 95%, about 99%, and about 99.99%. In some aspects, when the deposited metal is the lithium metal, the lithium purity can be greater than about 20% to up to 100%, including exemplary values of about 25%, about 30%, about 35%, about 40%, about 45%, about 50%, about 55%, about 60%, about 65%, about 70%, about 75%, about 80%, about 85%, about 90%, about 95%, about 99%, and about 99.99%.

In still further aspects, the deposited metal can have a recovery yield of up to 100%. For example, the metal recovery yield can be from about 20% to about 100%, including exemplary value of about 25%, about 30%, about 35%, about 40%, about 45%, about 50%, about 55%, about 60%, about 65%, about 70%, about 75%, about 80%, about 85%, about 90%, about 95%, about 99%, and about 99.99%. In some aspects, if lithium metal is deposited, the lithium recovery yield is from about 20% to about 100%, including exemplary value of about 25%, about 30%, about 35%, about 40%, about 45%, about 50%, about 55%, about 60%, about 65%, about 70%, about 75%, about 80%, about 85%, about 90%, about 95%, about 99%, and about 99.99%. In yet further aspects, the recovery yield can be anywhere between about 25% to about 50% or between about 50% to 100%.

In still further aspects, the metal recovery rate can be greater than about 1 g/cm$^2$ in 100 hours, greater than about 2 g/cm$^2$ in 100 hours, greater than about 5 g/cm$^2$ in 100 hours, greater than about 8 g/cm$^2$ in 100 hours, greater than about 10 g/cm$^2$ in 100 hours, greater than about 12 g/cm$^2$ in 100 hours, greater than about 15 g/cm$^2$ in 100 hours, greater than about 18 g/cm$^2$ in 100 hours, or greater than about 20 g/cm$^2$ in 100 hours. In yet further aspects, the metal recovery rate can be about 1 g/cm$^2$ in 5 hours.

In aspects where lithium is deposited, the lithium metal recovery rate can be greater than about 1 g/cm$^2$ in 100 hours, greater than about 2 g/cm$^2$ in 100 hours, greater than about 5 g/cm$^2$ in 100 hours, greater than about 8 g/cm$^2$ in 100 hours, greater than about 10 g/cm$^2$ in 100 hours, greater than about 12 g/cm$^2$ in 100 hours, greater than about 15 g/cm$^2$ in 100 hours, greater than about 18 g/cm$^2$ in 100 hours, or greater than about 20 g/cm$^2$ in 100 hours. In yet further aspects, the lithium metal recovery rate can be about 1 g/cm$^2$ in 5 hours.

In still further aspects, the deposited metal can be removed by any known in the art methods. In some methods, the deposited metal can be removed by a metal removal member that is configured to remove the deposited metal from the cathode surface. In some aspects, the metal removal member can be a scraper. However, it is also understood that any device that can accomplish the removal of the deposited metal can be considered. For example, the device can comprise an ultrasonic transducer that would allow removing the reduced metal by ultrasonic vibration. In yet other aspects, the removal of the metal can be accomplished by a shear. In such aspects, any desired device of a procedure that allows such removal can be utilized. It is further understood that a specific timing of the metal removal can be programmed, or it can be decided based on one or more sensors present in the system or can be continuous throughout the process.

In some exemplary aspects, the metal removal member can be positioned in the vicinity of the electrochemical cell. In such aspects, the metal removal member is not in fluid communication with the liquid medium. In yet further aspects, the metal removal member can be movable. For example, and without limitations, the metal removal member can be in electric communication with a control unit and can change its position depending on the methods' sequence. For example, and without limitations, the metal removal member can be in a retracted position during the deposition process and can be moved towards the cathode surface to remove the deposited metal when required. It is understood that in some aspects, the metal removal member positioning can be triggered by a sensor indicating whether the deposited metal needs to be collected. It is understood that the sensor can be optical or electronic. Exemplary steps of removing the deposited metal from the cathode surface are shown in FIG. 7.

In still further aspects, during the metal removal process, the cathode can be removed from the liquid medium into a separation medium to remove and collect the deposited metal. In such aspects, the separation medium is substantially different from the liquid medium. In still further aspects, the separation medium is substantially immiscible with the liquid medium. In yet still further aspects, the separation medium is substantially non-conductive. In some exemplary and unlimiting aspects, the separation medium can comprise inert gases, such as nitrogen or argon, or oil, and the like.

Figure 7:
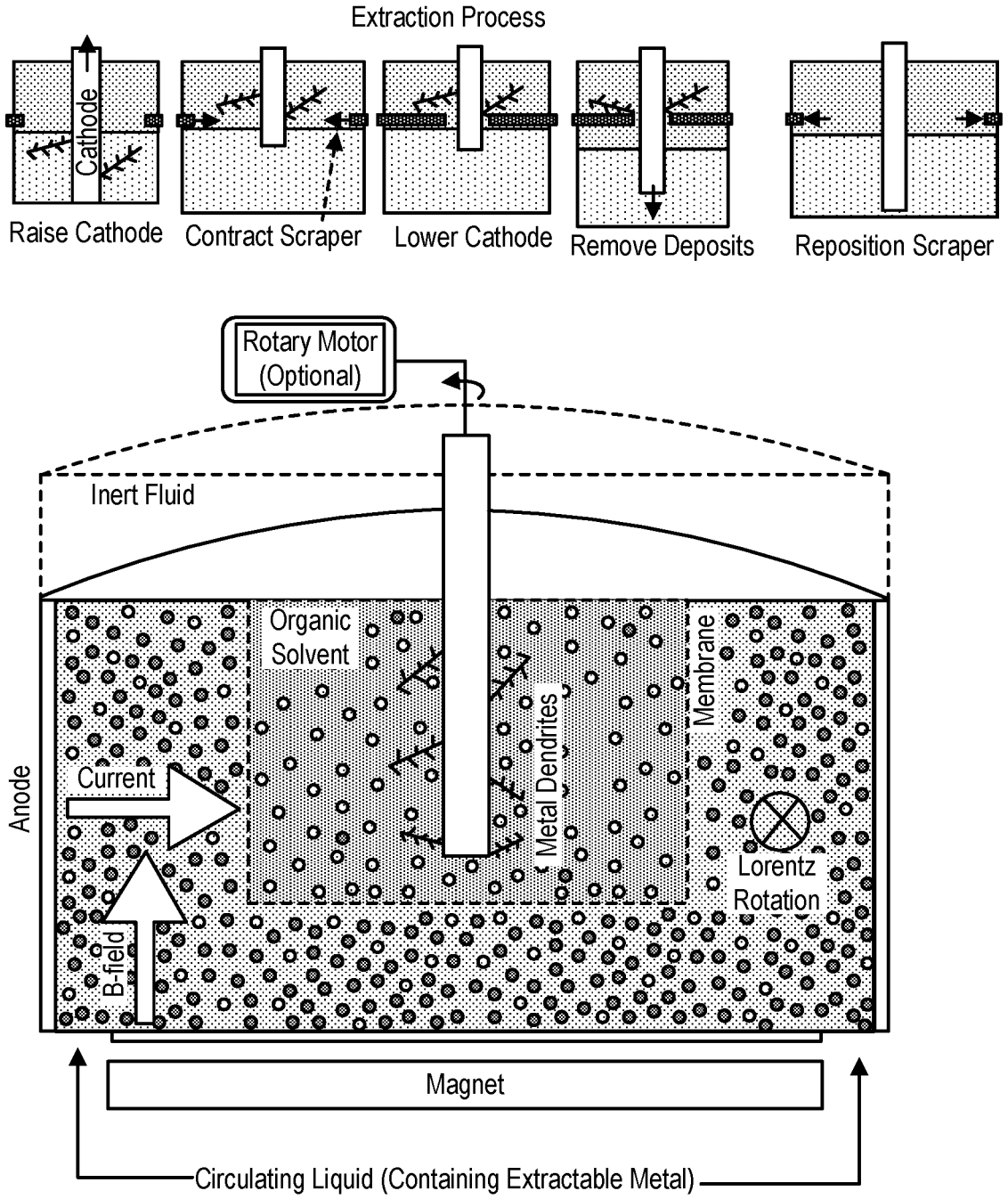
FIG. 7 depicts an exemplary system and process steps of the current disclosure in one aspect.

In the example shown in FIG. 7, the scraper is positioned between the liquid medium and the separation medium and is in the retracted position during the deposition process. In some exemplary aspects, when the step of removal begins, the cathode can be lifted substantially above the liquid medium into the separation medium, and the scraper is moved towards the cathode surface to remove the deposited metal. Upon finishing the metal removal, the scraper is retracted, and the cathode is repositioned within the liquid medium for continuous operation. It is understood that the movements and performance of the cathode, the metal removal member, and/or sensor, if present, can be controlled with the external control unit. It is further understood that the control unit can have a continuous feedback operation mode and can adjust process parameters based on the electrochemical cell status at any given point of the process.

Systems

Also disclosed herein are aspects directed to a system comprising: a) an electrochemical cell comprising an anode and a cathode; wherein the cathode and anode have a longitudinal axis; b) wherein the electrochemical cell is configured to receive a liquid medium comprising metal ions such that the liquid medium is in a fluid communication with the cathode; c) a magnet positioned to form a magnetic field parallel to the longitudinal axis of the cathode and anode such as to induce an azimuthal motion of the liquid medium; and wherein the system is selective to a metal deposition on the cathode.

Yet, in other aspects, also disclosed herein are systems comprising: a) an electrochemical cell comprising an anode and a cathode; wherein the cathode and anode have a longitudinal axis; wherein the electrochemical cell is configured to selectively form a reduced metal deposited on the cathode; b) wherein the electrochemical cell is configured to receive a liquid medium comprising metal ions such that the liquid medium is in a fluid communication with the cathode, and c) a member configured continuously to remove the reduced metal from the cathode.

Also disclosed herein is a system comprising: a) an electrochemical cell comprising an anode and a cathode; wherein the cathode and anode have a longitudinal axis; b) wherein the electrochemical cell is configured to receive a liquid medium comprising metal ions such that the liquid medium is in fluid communication with the cathode; c) a magnet positioned to form a magnetic field parallel to the longitudinal axis of the cathode and anode, wherein when there is a current flow from the anode to the cathode, the magnetic field is orthogonal to the current flow and induces a convectional motion of the liquid medium; and wherein the system is selective to a metal deposition on the cathode.

As discussed in detail above, the liquid medium can comprise any metal ions that can be electrodeposited to form a solid metal on the cathode. In yet further aspects, the metal ions are lithium ions, and the solid metal deposited on the cathode is a lithium metal. The systems disclosed herein can use any of the disclosed above liquid media.

In still further aspects, the electrochemical cell used in the disclosed system can further be in electric communication with a voltage source such that a voltage can be supplied between the anode and cathode to initiate the electroreduction of the metal ions. In still further aspects, the provided voltage can be in a range from about −5V to about 5 V, including exemplary values of about −4 V, about −3 V, about −2 V, about −1 V, about 1 V, about 2 V, about 3 V, and about 4 V. It is understood, however, that this range is exemplary, and any voltage range within the redox potential of the wanted ionic species can be utilized.

In still further aspects, it is understood that while the magnet can be present in the system, it does not have to be used for metal deposition purposes. In still further aspects, if the magnet is used in the system, it can be any suitable for the disclosed purpose magnet that is known in the art. In some aspects, the magnet is a permanent magnet. While in other aspects, the magnet can be an electromagnet. In certain aspects, the magnet can be positioned beneath the electrochemical cell.

It is also understood that disclosed herein aspects can comprise a system where the magnet is not present, and the metal deposition rates and selectivity are enhanced by other methods as described above.

In still further aspects, the system is in electrical communication with a power source. The power supply can be configured to activate a magnet if the magnet is an electromagnet. In still further aspects, the power source and the voltage source can be the same or different.

In yet further aspect, the system further comprises a control unit. The control unit can be in electrical communication with one or more of the voltage source, the power source, the magnet, and/or the electrodes. The control unit can be in a feedback loop with the electrochemical cell. The control unit is configured to tune the system's parameters, such as the amount and duration of the applied voltage, strength and duration of the magnetic field, and the like.

In still further aspects, the magnetic field formed in the system can be from about 1 mT to about 0.2 T, including exemplary values of about 5 mT, about 10 mT, about 20 mT, about 30 mT, about 40 mT, about 50 mT, about 60 mT, about 70 mT, about 80 mT, about 90 mT, about 100 mT, about 125 mT, about 150 mT, and about 175 mT.

In still further aspects, the magnetic field formed by the disclosed herein magnet can induce continuous advection of the liquid medium. While in still further aspects, the magnetic field can form an electromagnetic centrifuge in the liquid medium.

In still further aspects, any of the disclosed above electrochemical cells can be utilized. In yet further aspects, the anode and/or cathode can comprise any of the disclosed above materials.

The liquid medium used in the disclosed system can comprise any of the disclosed above ions. For example, the liquid medium can comprise one or more of sodium, magnesium, calcium, potassium, barium, or one or more rare earth elements.

In still further aspects, the systems disclosed herein can also comprise additional components. For example, the system can comprise any of the disclosed above further solvents and any of the disclosed above selectivity approving additives.

Similarly, in some aspects, the system can further comprise a separator that can be used with or without further solvent. For example, in some aspects, the separator can be used to selectively separate the desired metal ions from the rest ions. In yet other aspects, the separator can be used to partition the further solvent from the liquid medium, wherein the separator is substantially permeable to lithium ions (or any other desired ions). Any of the disclosed above separators can be utilized in the disclosed system. It is further understood that any combinations of the magnet, further solvent, and/or separator can be used in the systems disclosed herein.

In still further aspects, the system disclosed herein allows to deposit metals having purity up to 100%, including exemplary values of about 25%, about 30%, about 35%, about 40%, about 45%, about 50%, about 55%, about 60%, about 65%, about 70%, about 75%, about 80%, about 85%, about 90%, about 95%, about 99%, and about 99.99%. In some aspects, when the deposited metal is the lithium metal, the lithium purity can be greater than about 20% to up to 100%, including exemplary values of about 25%, about 30%, about 35%, about 40%, about 45%, about 50%, about 55%, about 60%, about 65%, about 70%, about 75%, about 80%, about 85%, about 90%, about 95%, about 99%, and about 99.99%.

In still further aspects, the system disclosed herein allows to deposit metals having a recovery yield up to 100%, including exemplary value of about 25%, about 30%, about 35%, about 40%, about 45%, about 50%, about 55%, about 60%, about 65%, about 70%, about 75%, about 80%, about 85%, about 90%, about 95%, about 99%, and about 99.99%. In yet further aspects, the recovery yield can be anywhere between about 25% to about 50% or between about 50% to 100%. In some aspects, when lithium is deposited, for example, the lithium recovery yield can be from about 20% to about 100%, including exemplary value of about 25%, about 30%, about 35%, about 40%, about 45%, about 50%, about 55%, about 60%, about 65%, about 70%, about 75%, about 80%, about 85%, about 90%, about 95%, about 99%, and about 99.99%. In yet further aspects, the recovery yield can be anywhere between about 25% to about 50% or between about 50% to 100%.

In still further aspects, the system disclosed herein allows depositing metals with a recovery rate greater than about 1 $g/cm^2$ in 100 hours, greater than about 2 $g/cm^2$ in 100 hours, greater than about 5 $g/cm^2$ in 100 hours, greater than about 8 g/cm$^2$ in 100 hours, greater than about 10 g/cm$^2$ in 100 hours, greater than about 12 g/cm$^2$ in 100 hours, greater than about 15 g/cm$^2$ in 100 hours, greater than about 18 g/cm$^2$ in 100 hours, or greater than about 20 g/cm$^2$ in 100 hours. In yet further aspects, the recovery rate can be about 1 g/cm$^2$ in 5 hours. For example, when lithium metal is deposited, its recovery rate can be greater than about 1 g/cm$^2$ in 100 hours, greater than about 2 g/cm$^2$ in 100 hours, greater than about 5 g/cm$^2$ in 100 hours, greater than about 8 g/cm$^2$ in 100 hours, greater than about 10 g/cm$^2$ in 100 hours, greater than about 12 g/cm$^2$ in 100 hours, greater than about 15 g/cm$^2$ in 100 hours, greater than about 18 g/cm$^2$ in 100 hours, or greater than about 20 g/cm$^2$ in 100 hours. In yet further aspects, the recovery rate of the lithium metal can be about 1 g/cm$^2$ in 5 hours.

In still further aspects, as disclosed herein, the system can comprise a metal removing member that is configured to continuously remove the reduced deposited metal from the cathode surface. Such a member can be adapted to scrape the metal from the cathode surface. In still further aspects, the member removing the metal can be controlled by the control unit.

In some aspects, the system can further comprise a sensor configured to trigger the metal removing member to initiate the removal of the deposited metal from the cathode surface. It is understood that the sensor can be any sensory that is adapted to perform this task. In some aspects, the sensor can be optical or electronic.

By way of non-limiting illustration, examples of certain aspects of the present disclosure are given below.

EXAMPLES

The following examples are put forth so as to provide those of ordinary skill in the art with a complete disclosure and description of how the compounds, compositions, articles, devices, and/or methods claimed herein are made and evaluated and are intended to be purely exemplary and are not intended to limit the disclosure. Efforts have been made to ensure accuracy with respect to numbers (e.g., amounts, temperature, etc.), but some errors and deviations should be accounted for. Unless indicated otherwise, parts are parts by weight, temperature is degrees C. or is at ambient temperature, and pressure is at or near atmospheric.

Example 1

It was shown that the rate of acetophenone and Cu electrochemical reduction in the presence of the magnetic field with B~0.1 T to about 1 T can be enhanced by >300% under diffusion-limited conditions. The influence of magnetic field on electrochemical reduction and dendritic growth, however, remains largely unexplored. Theoretical predictions show that the presence of an external magnetic field induces a Lorentz force that results in convection in the electrolyte and increases the rate of radial mass transport. Near the electrodes, flow paths are perturbed as ions are reduced, and the Lorentz force advects mass away from the surface. Experiments have also shown that magnetic fields can manipulate the mechanisms that control the dynamics and morphology of Cu dendrite growth. For example, in a circular electrolytic cell filled with 0.2 M $CuSO_4$ at 0.4 T, the magnetic field can alter dendritic fractal dimensionality and packing fraction and add chirality to the dendrites.).

Figure 4:
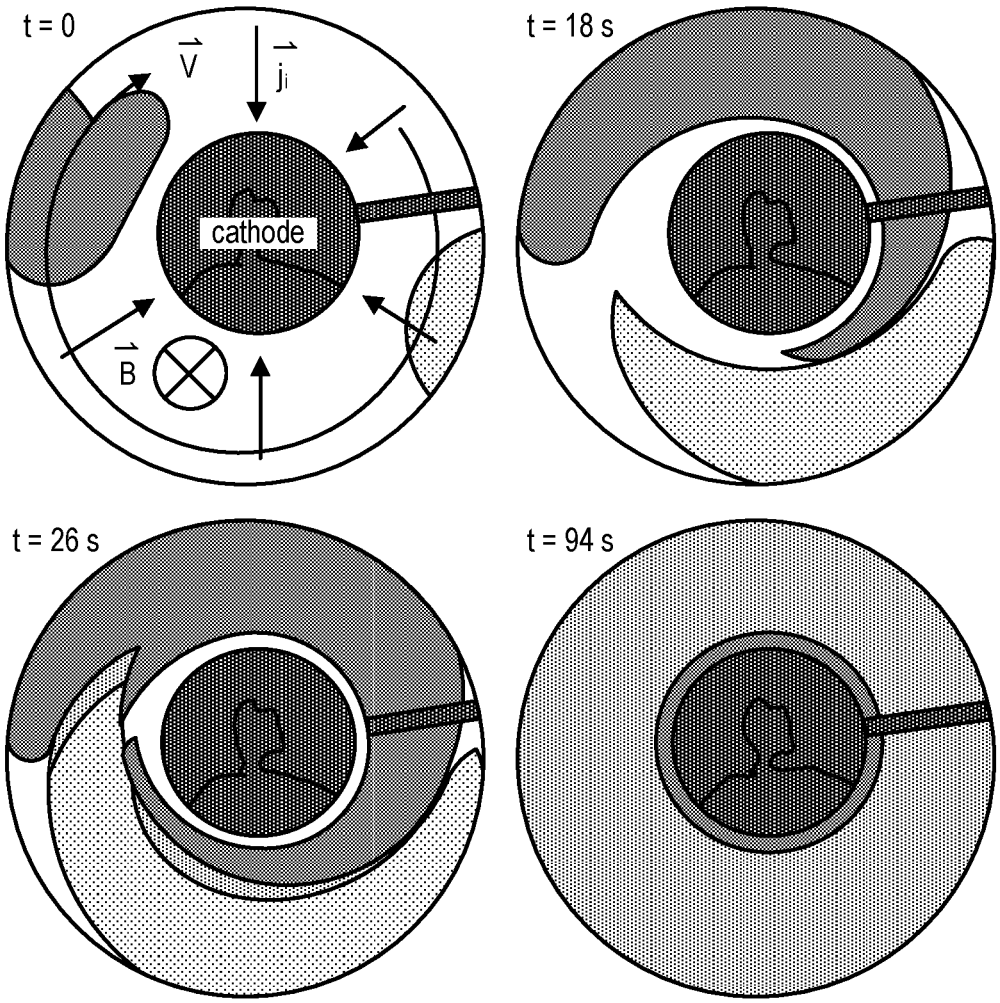
FIG. 4 depicts an exemplary electromagnetically induced rotation of ionic species. Smaller ions shown in yellow are rotated faster and settle closer to the cathodic collector placed in the center of the cell.
Figure 5:
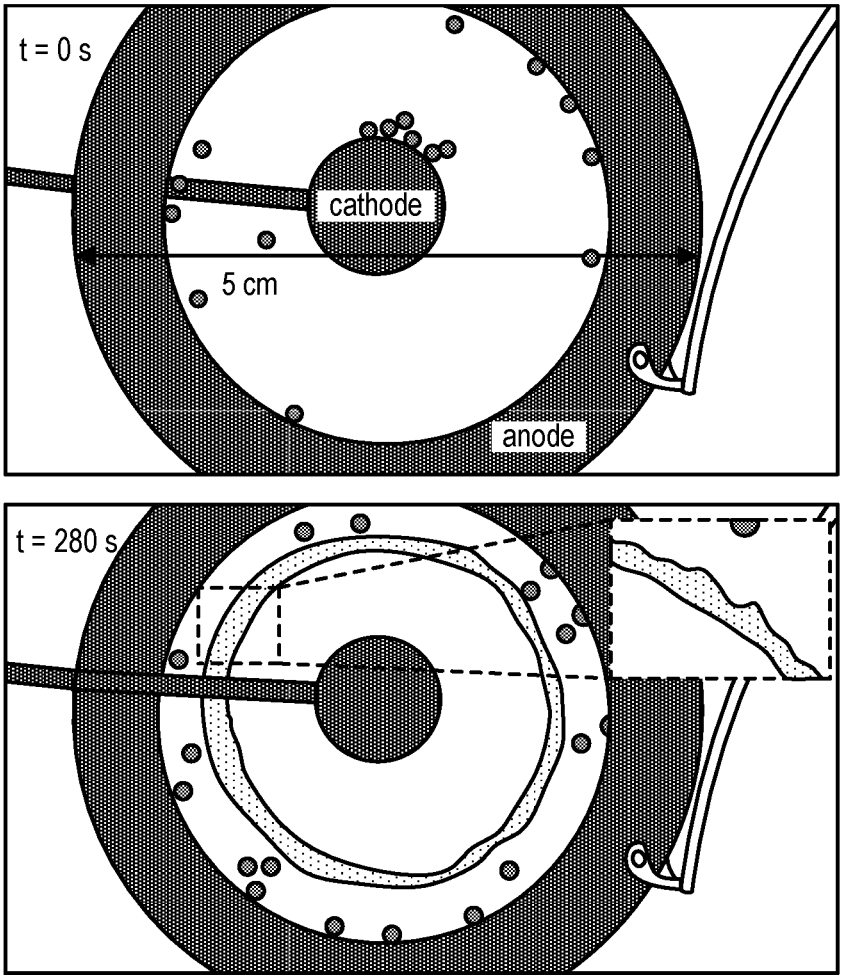
FIG. 5 depicts an exemplary electromagnetically induced rotation of particles. Smaller green particles accumulate closer to the cathode.

To improve $Li^+$ selectivity for rapid, energy-efficient Li electro-reduction, ion partitioning through the addition of the organic solvents, ion-selective membranes, and electromagnetic centrifugation was added to an experimental setup. Preliminary experiments demonstrate the differential rotation of particulate and ionic species based on the mass-to-charge ratio (FIGS. 4 and 5). Specifically, the experimental cell was comprised of concentric graphite electrodes, with the cathode in the middle. The graphite anode positioned outside of the cathode had an outer diameter of 5 cm. It was found that the radial ionic current interacts with an axial magnetic field (B~0.4 T) to generate azimuthal convection in the cell (FIG. 4).

Sustained rotational velocities in excess of 150 rpm have been measured in preliminary experiments for aqueous solutions with currents ~20 mA. These results were obtained with two different soluble dyes (Brilliant Blue FCF, blue, and tartrazine, yellow). The rotation of these dyes has shown that the yellow dye, having a lower m/q ratio (FIG. 4), rotates faster and partitions itself close to the cathode when compared with the blue dye having a higher m/q ratio. Similarly, the rotation of small polyethylene (green, D 30 microns, ρ=1.05 g/cc) and large nylon particles (D=1.58 mm, ρ=1.15 g/cc) resulted in the separation of lighter particles from the denser ones (FIG. 5).

Example 2

Off-the-shelf ion-selective membranes were tested for further selectivity for Li-ion transport. Non-filtration membranes have been used to pre-concentrate Li from brines. Various studies investigate how nanochannel size, surface charge, morphology, driving force, and environmental factors (e.g., pH, flow velocity, current density, etc.) can affect Li selectivity. It was found that, for example, a membrane consisting of a linear polystyrene sulfonate threaded HKUST-1 MOF on solid-state support exhibited ion selectivity of 35, 67, and 1815 for $Li^+/Na^+$, $Li^+/K^+$, and $Li^+/Mg^{2+}$ respectively with transport rates of 6.75 mol/h/m$^2$.

Other single-layer membranes, including poly(ethylene terephthalate) with the channel dimensions ~0.6 nm, showed $Li^+$ over $Na^+$ selectivity of 10.46 and $Li^+$ over $K^+$ selectivity of 16, and ion transportation rates of 10 mol/h/m$^2$ (Razmjou, A.; Asadnia, M.; Hosseini, E.; Habibnejad Korayem, A.; Chen, V. Design Principles of Ion Selective Nanostructured Membranes for the Extraction of Lithium Ions. Nat. Commun. 2019, 10(1), 1-16).

It was also shown that the use of solvent extraction can partition lithium ions from the brine, with distribution coefficients $D_{Li}=[Li]_{org}/[Li]_{aq}$~100 (Lee, D. A.; Taylor, W. L.; McDowell, W. J.; Drury, J. S. Solvent Extraction of Lithium. *J. Inorg. Nucl. Chem.* 1968, 30, 2807-2821).

Example 3

The market viability was evaluated for the electromagnetically-enhanced dendritic metal depositions. It was found that the disclosed methods offer a novel pathway for the extraction of lithium ions from the aqueous solutions having low lithium concentrations. The disclosed methods provided high-value solid lithium metal that can be directly used in the next-generation $_2CO_3$ and LiOH if needed.

It was found that an increase in ionic selectivity, according to the disclosed aspects, can increase Faradaic efficiency and result in lower electrochemical energy costs (FIG. 6). Preliminary calculations show that a solution with ~0.1 $mol_{Li+}/mol_{cations}$, i.e., 10% Faradaic efficiency, allows Li-metal extraction at the cost of less than $3 per kg (~100 kWh/kg) from the brine solution having about 1 ppm of lithium ions.

Additional advantages of the disclosed methods lay in reduced use of reagents and immediate generation of lithium metal.

The devices, systems, and methods of the appended claims are not limited in scope by the specific devices, systems, and methods described herein, which are intended as illustrations of a few aspects of the claims. Any devices, systems, and methods that are functionally equivalent are intended to fall within the scope of the claims. Various modifications of the devices, systems, and methods, in addition to those shown and described herein, are intended to fall within the scope of the appended claims. Further, while only certain representative devices, systems, and method steps disclosed herein are specifically described, other combinations of the devices, systems, and method steps also are intended to fall within the scope of the appended claims, even if not specifically recited. Thus, a combination of steps, elements, components, or constituents may be explicitly mentioned herein or less; however, other combinations of steps, elements, components, and constituents are included, even though not explicitly stated.

Although several aspects of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove and that many modifications and other embodiments are intended to be included within the scope of the appended claims. Moreover, although specific terms are employed herein, as well as in the claims which follow, they are used only in a generic and descriptive sense and not for the purposes of limiting the described invention or the claims which follow.

Unless defined otherwise, all technical and scientific terms used herein have the same meanings as commonly understood by one of skill in the art to which the disclosed invention belongs. Publications cited herein and the materials for which they are cited are specifically incorporated by reference.

The claims are not intended to include, and should not be interpreted to include, means-plus- or step-plus-function limitations unless such a limitation is explicitly recited in a given claim using the phrase(s) "means for" or "step for," respectively.

Exemplary Aspects

In view of the described processes and compositions, hereinbelow are described certain more particularly described aspects of the disclosures. These particularly recited aspects should not, however, be interpreted to have any limiting effect on any different claims containing different or more general teachings described herein or that the "particular" aspects are somehow limited in some way other than the inherent meanings of the language and formulas literally used therein.

Example 1

A method for selective recovery of a metal from a liquid medium comprising ions of the metal wherein the method comprises: applying a voltage to an electrochemical cell comprising the liquid medium, an anode and a cathode to induce an electric current flow from the anode to the cathode, wherein the voltage is effective to induce a reduction of the metal ions on the cathode; applying a magnetic field directed orthogonally to the current flow to induce an azimuthal motion of the liquid medium, thereby rotating the liquid medium around the cathode; depositing reduced metal on the cathode; and recovering the reduced metal.

Example 2

The method of any examples herein, particularly example 1, wherein the liquid medium comprises an aqueous solution, an organic solution, a nonaqueous solution, or a combination thereof.

Example 3

The method of any examples herein, particularly example 1 or 2, wherein the metal comprises lithium, sodium, magnesium, calcium, potassium, barium, or one or more rare earth elements, or alloys thereof.

Example 4

The method of any examples herein, particularly examples 1-3, wherein the metal ions are present in an amount of less than about 2,000 ppm in the liquid medium.

Example 5

The method of any examples herein, particularly examples 1-4, wherein the reduced metal forms a plurality of fractal dendrites, a mossy structure, a needle-like structure, or a combination thereof on the cathode.

Example 6

The method of any examples herein, particularly example 5, wherein the reduced metal is continuously removed from the cathode.

Example 7

The method of any examples herein, particularly examples 1-6, wherein the cathode and anode have the same or different geometrical shape.

Example 8

The method of any examples herein, particularly examples 1-7, wherein the cathode is a rotating electrode.

Example 9

The method of any examples herein, particularly examples 1-7, wherein the anode and cathode are disposed concentrically such that the anode is positioned around the cathode at a radial distance.

Example 10

The method of any examples herein, particularly example 9, wherein the current flow is a radial current flow.

Example 11

The method of any examples herein, particularly examples 1-10, wherein the magnetic field induces continuous advection of the liquid medium.

Example 12

The method of any examples herein, particularly examples 1-11, wherein the magnetic field forms an electromagnetic centrifuge.

Example 13

The method of any examples herein, particularly examples 1-12, wherein the liquid medium comprises ions of one or more of lithium, sodium, magnesium, calcium, potassium, barium, or one or more rare earth elements, or any combination thereof.

Example 14

The method of any examples herein, particularly examples 1-13, wherein the voltage is from about −5V to about 5 V.

Example 15

The method of any examples herein, particularly examples 1-14, wherein the magnetic field is applied at from about 1 mT to about 0.2 T.

Example 16

The method of any examples herein, particularly examples 1-15, wherein the electrochemical cell further comprises a further solvent that is substantially immiscible with the liquid medium and is in flow communication with the cathode.

Example 17

The method of any examples herein, particularly example 16, wherein the further solvent is an organic solvent that is selective to the metal to be deposited.

Example 18

The method of any examples herein, particularly example 17, wherein the organic solvent comprises dimethyl carbonate, diethyl carbonate, ethyl methyl carbonate, polyoxylene, propylene carbonate, fluoroethylene carbonate, ethylene carbonate, room-temperature ionic liquids, or any combination thereof.

Example 19

The method of any examples herein, particularly examples 17-18, wherein the organic solvent further comprises one or more metal selectivity improving additives.

Example 20

The method of any examples herein, particularly example 19, wherein the one or more metal selectivity improving additives comprise a chelating agent, $TiO_2$, or any combination thereof.

Example 21

The method of any examples herein, particularly examples 16-20, wherein the further solvent has a density that is substantially similar to a density of the liquid medium.

Example 22

The method of any examples herein, particularly examples 1-21, further comprising disposing a separator, wherein the separator is substantially permeable and selective to the metal ions.

Example 23

The method of any examples herein, particularly example 22, wherein the separator is configured to partition the further solvent from the liquid medium.

Example 24

The method of any examples herein, particularly example 22 or 23, wherein the separator comprises a metal-organic framework (MOF), polyethylene terephthalate membrane, cellulose acetate butyrate), polysulfone, polybenzimidazole, poly(amideimide), polyethersulfone, polyphenylsulfone, polyimide, polyacrylonitile, poly(ethylene oxide), poly (ether ether ketone), poly(vinylidene fluoride), poly(ethylene chlorotrifluoroethylene), polycarbonate, polystyrene, poly(ether-block-amide), acrylonitrile butadiene styrene, bisphonenolsulfone, carbon nanotubes, or derivatives and combinations thereof.

Example 25

The method of any examples herein, particularly examples 1-24, wherein the metal is recovered in situ.

Example 26

The method of any examples herein, particularly examples 1-25, wherein the method is a batch method or a continuous method.

Example 27

The method of any examples herein, particularly examples 1-26, wherein the liquid medium is a geothermal brine, produced waters, wastewater, recycled batteries' electrolytes, seawater, desalination brines, aquifer brines, or any combination thereof.

Example 28

The method of any examples herein, particularly examples 1-27, wherein the cathode comprises copper, carbon, graphite, sodium, lithium, $\lambda$-$MnO_2$ and $LiMn_2O_4$ spinel, olivine $LiFePO_4$ and $FePO_4$, or layered $LiNiMnO_2$ Example 29

The method of any examples herein, particularly examples 1-28, wherein the anode comprises carbon or platinum.

Example 30

The method of any examples herein, particularly examples 1-29, wherein the deposited metal has a purity from greater than 20% to 100%.

Example 31

The method of any examples herein, particularly examples 1-30, wherein the deposited metal has a recovery yield from about 50% to 100%.

Example 32

The method of any examples herein, particularly examples 1-31, wherein a recovery rate is greater than about 1 $g/cm^2$ in 100 hours.

Example 33

The method of any examples herein, particularly example 32, wherein the recovery rate is about 1 $g/cm^2$ in 5 hours.

Example 34

A method for selective recovery of a metal from a liquid medium comprising ions of the metal wherein the method comprises: applying a voltage to an electrochemical cell comprising the liquid medium, a further solvent, an anode and a cathode to induce an electric current flow from the anode to the cathode, wherein the voltage is effective to induce a reduction of the metal ions on the cathode; and wherein the further solvent is substantially immiscible with the liquid medium and is in flow communication with the cathode; depositing reduced metal on the cathode; and recovering the reduced metal.

Example 35

The method of any examples herein, particularly example 34, wherein the liquid medium comprises an aqueous solution, an organic solution, a nonaqueous solution, or a combination thereof.

Example 36

The method of any examples herein, particularly example 34 or 35, wherein the metal comprises lithium, sodium, magnesium, calcium, potassium, barium, or one or more rare earth elements, or alloys thereof.

Example 37

The method of any examples herein, particularly examples 34-36, wherein the metal ions are present in an amount of less than about 2,000 ppm in the liquid medium.

Example 38

The method of any examples herein, particularly examples 34-37, wherein the reduced metal forms a plurality of fractal dendrites, a mossy structure, a needle-like structure, or a combination thereof on the cathode.

Example 39

The method of any examples herein, particularly example 38, wherein the reduced metal is continuously removed from the cathode.

Example 40

The method of any examples herein, particularly example 39, wherein the further solvent is an organic solvent that is selective to the metal to be deposited.

Example 41

The method of any examples herein, particularly example 40, wherein the organic solvent comprises dimethyl carbonate, diethyl carbonate, ethyl methyl carbonate, polyoxylene, propylene carbonate, fluoroethylene carbonate, ethylene carbonate, room-temperature ionic liquids, or any combination thereof.

Example 42

The method of any examples herein, particularly examples 34-41, wherein the further solvent further comprises one or more metal selectivity improving additives.

Example 43

The method of any examples herein, particularly example 42, wherein the one or more metal selectivity improving additives comprise a chelating agent, $TiO_2$, or any combination thereof.

Example 44

The method of any examples herein, particularly examples 34-43, wherein the further solvent has a density that is substantially similar to a density of the liquid medium.

Example 45

The method of any examples herein, particularly examples 34-44, wherein the cathode and anode have the same or different geometrical shape.

Example 46

The method of any examples herein, particularly examples 34-45, wherein the cathode is a rotating electrode.

Example 47

The method of any examples herein, particularly examples 34-46, further comprises a step of applying a magnetic field directed orthogonally to the current flow to induce an azimuthal motion of the liquid medium, thereby rotating the liquid medium around the cathode.

Example 48

The method of any examples herein, particularly example 47, wherein the anode and cathode are disposed concentrically such that the anode is positioned around the cathode at a radial distance.

Example 49

The method of any examples herein, particularly examples 47 or 48, wherein the current flow is a radial current flow.

Example 50

The method of any examples herein, particularly examples 47-49, wherein the magnetic field induces continuous advection of the liquid medium.

Example 51

The method of any examples herein, particularly examples 47-50, wherein the magnetic field forms an electromagnetic centrifuge.

Example 52

The method of any examples herein, particularly examples 34-51, wherein the liquid medium comprises ions of one or more of lithium, sodium, magnesium, calcium, potassium, barium, or one or more rare earth elements, or any combination thereof.

Example 53

The method of any examples herein, particularly examples 34-52, wherein the voltage is from about −5V to about 5 V.

Example 54

The method of any examples herein, particularly examples 47-53, wherein the magnetic field is applied at from about 1 mT to about 0.2 T.

Example 55

The method of any examples herein, particularly examples 34-54, further comprising disposing a separator, wherein the separator is substantially permeable and selective to the metal ions.

Example 56

The method of any examples herein, particularly example 55, wherein the separator is configured to partition the further solvent from the liquid medium.

Example 57

The method of any examples herein, particularly example 55 or 56, wherein the separator comprises a metal-organic framework (MOF), polyethylene terephthalate membrane, cellulose acetate butyrate), polysulfone, polybenzimidazole, poly(amideimide), polyethersulfone, polyphenylsulfone, polyimide, polyacrylonitile, poly(ethylene oxide), poly (ether ether ketone), poly(vinylidene fluoride), poly(ethylene chlorotrifluoroethylene), polycarbonate, polystyrene, poly(ether-block-amide), acrylonitrile butadiene styrene, bisphonenolsulfone, carbon nanotubes, or derivatives and combinations thereof.

Example 58

The method of any examples herein, particularly examples 34-57, wherein the metal is recovered in situ.

Example 59

The method of any examples herein, particularly examples 34-58, wherein the method is a batch method or a continuous method.

Example 60

The method of any examples herein, particularly examples 34-59, wherein the liquid medium is a geothermal brine, produced waters, wastewater, recycled batteries' electrolytes, seawater, desalination brines, aquifer brines, or any combination thereof.

Example 61

The method of any examples herein, particularly examples 34-60, wherein the cathode comprises copper, carbon, graphite, sodium, lithium, $\lambda$-$MnO_2$ and $LiMn_2O_4$ spinel, olivine $LiFePO_4$ and $FePO_4$, or layered $LiNiMnO_2$.

Example 62

The method of any examples herein, particularly examples 34-61, wherein the anode comprises carbon or platinum.

Example 63

The method of any examples herein, particularly examples 34-62, wherein the deposited metal has a purity from greater than 20% to 100%.

Example 64

The method of any examples herein, particularly examples 34-63, wherein the deposited metal has a recovery yield from about 50% to 100%.

Example 65

The method of any examples herein, particularly examples 34-64, wherein a recovery rate is greater than about 1 $g/cm^2$ in 100 hours.

Example 66

The method of any examples herein, particularly example 65, wherein the recovery rate is about 1 $g/cm^2$ in 5 hours.

Example 67

A method for selective recovery of a metal from a liquid medium comprising ions of the metal wherein the method comprises: applying a voltage to an electrochemical cell comprising the liquid medium, an anode and a cathode to induce an electric current flow from the anode to the cathode, wherein the voltage is effective to induce a reduction of the metal ions on the cathode; wherein the electrochemical cell further comprises a separator positioned between the cathode and anode, and wherein the separator is substantially permeable and selective to the metal ions; depositing reduced metal on the cathode; and recovering the reduced metal.

Example 68

The method of any examples herein, particularly example 67, wherein the liquid medium comprises an aqueous solution, an organic solution, a nonaqueous solution, or a combination thereof.

Example 69

The method of any examples herein, particularly example 67 or 68, wherein the metal comprises lithium, sodium, magnesium, calcium, potassium, barium, or one or more rare earth elements, or alloys thereof.

Example 70

The method of any examples herein, particularly examples 67-69, wherein the metal ions are present in an amount of less than about 2,000 ppm in the liquid medium.

Example 71

The method of any examples herein, particularly examples 67-70, wherein the reduced metal forms a plurality of fractal dendrites, a mossy structure, a needle-like structure, or a combination thereof on the cathode.

Example 72

The method of any examples herein, particularly example 71, wherein the reduced metal is continuously removed from the cathode.

Example 73

The method of any examples herein, particularly examples 67-72, wherein the liquid medium comprises ions of one or more of lithium, sodium, magnesium, calcium, potassium, barium, or one or more rare earth elements, or any combination thereof.

Example 74

The method of any examples herein, particularly examples 67-73, wherein the separator comprises a metal-organic framework (MOF), polyethylene terephthalate membrane, cellulose acetate butyrate), polysulfone, polybenzimidazole, poly(amideimide), polyethersulfone, polyphenylsulfone, polyimide, polyacrylonitile, poly(ethylene oxide), poly(ether ether ketone), poly(vinylidene fluoride), poly(ethylene chlorotrifluoroethylene), polycarbonate, polystyrene, poly(ether-block-amide), acrylonitrile butadiene styrene, bisphonenolsulfone, carbon nanotubes, or derivatives and combinations thereof.

Example 75

The method of any examples herein, particularly examples 67-74, further comprising a further solvent that is substantially immiscible with the liquid medium and is in flow communication with the cathode.

Example 76

The method of any examples herein, particularly example 75, wherein the further solvent is an organic solvent that is selective to the metal to be deposited.

Example 77

The method of any examples herein, particularly example 76, wherein the organic solvent comprises dimethyl carbonate, diethyl carbonate, ethyl methyl carbonate, polyoxylene, propylene carbonate, fluoroethylene carbonate, ethylene carbonate, room-temperature ionic liquids, or any combination thereof.

Example 78

The method of any examples herein, particularly examples 75-77, wherein the further solvent further comprises one or more metal selectivity improving additives.

Example 79

The method of any examples herein, particularly example 78, wherein the one or more metal selectivity improving additives comprise a chelating agent, $TiO_2$, or any combination thereof.

Example 80

The method of any examples herein, particularly examples 75-79, wherein the further solvent has a density that is substantially similar to a density of the liquid medium.

Example 81

The method of any examples herein, particularly examples 75-80, wherein the separator is configured to partition the further solvent from the liquid medium.

Example 82

The method of any examples herein, particularly examples 68-81, wherein the cathode and anode have the same or different geometrical shape.

Example 83

The method of any examples herein, particularly examples 68-82, wherein the cathode is a rotating electrode.

Example 84

The method of any examples herein, particularly examples 68-83, further comprising a step of applying a magnetic field directed orthogonally to the current flow to induce an azimuthal motion of the liquid medium, thereby rotating the liquid medium around the cathode.

Example 85

The method of any examples herein, particularly example 84, wherein the anode and cathode are disposed concentrically such that the anode is positioned around the cathode at a radial distance.

Example 86

The method of any examples herein, particularly examples 84 or 85, wherein the current flow is a radial current flow.

Example 87

The method of any examples herein, particularly examples 84-86, wherein the magnetic field induces continuous advection of the liquid medium.

Example 88

The method of any examples herein, particularly examples 84-87, wherein the magnetic field forms an electromagnetic centrifuge.

Example 89

The method of any examples herein, particularly examples 68-88, wherein the voltage is from about −5V to about 5 V.

Example 90

The method of any examples herein, particularly examples 84-89, wherein the magnetic field is applied at from about 1 mT to about 0.2 T.

Example 91

The method of any examples herein, particularly examples 68-90, wherein the metal is recovered in situ.

Example 92

The method of any examples herein, particularly examples 68-91, wherein the method is a batch method or a continuous method.

Example 93

The method of any examples herein, particularly examples 68-92, wherein the liquid medium is a geothermal brine, produced waters, wastewater, recycled batteries' electrolytes, seawater, desalination brines, aquifer brines, or any combination thereof Example 94

The method of any examples herein, particularly examples 68-93, wherein the cathode comprises copper, carbon, graphite, sodium, lithium, $\lambda$-$MnO_2$ and $LiMn_2O_4$ spinel, olivine $LiFePO_4$ and $FePO_4$, or layered $LiNiMnO_2$.

Example 95

The method of any examples herein, particularly examples 68-94, wherein the anode comprises carbon or platinum.

Example 96

The method of any examples herein, particularly examples 68-95, wherein the deposited metal has a purity from greater than 20% to 100%.

Example 97

The method of any examples herein, particularly examples 68-96, wherein the deposited metal has a recovery yield from about 50% to 100%.

Example 98

The method of any examples herein, particularly examples 68-97, wherein a recovery rate is greater than about 1 $g/cm^2$ in 100 hours.

Example 99

The method of any examples herein, particularly example 98, wherein the recovery rate is about 1 $g/cm^2$ in 5 hours.

Example 100

A method for selective recovery of a metal from a liquid medium comprising ions of the metal wherein the method comprises: applying a voltage to an electrochemical cell comprising the liquid medium, a further solvent, an anode and a cathode to induce an electric current flow from the anode to the cathode, wherein the voltage is effective to induce a reduction of the metal ions on the cathode; and wherein the further solvent is substantially immiscible with the liquid medium and is in flow communication with the cathode; applying a magnetic field directed orthogonally to the current flow to induce an azimuthal motion of the liquid medium, thereby rotating the liquid medium around the cathode; depositing reduced metal on the cathode; and recovering the reduced metal.

Example 101

A method for selective recovery of a metal from a liquid medium comprising ions of the metal wherein the method comprises: applying a voltage to an electrochemical cell comprising the liquid medium, an anode and a cathode to induce an electric current flow from the anode to the cathode, wherein the voltage is effective to induce a reduction of the metal ions on the cathode; wherein the electrochemical cell further comprises a separator positioned between the cathode and anode, and wherein the separator is substantially permeable and selective to the metal ions; applying a magnetic field directed orthogonally to the current flow to induce an azimuthal motion of the liquid medium, thereby rotating the liquid medium around the cathode; depositing reduced metal on the cathode; and recovering the reduced metal.

Example 102

A method for selective recovery of a metal from a liquid medium comprising ions of the metal wherein the method comprises: applying a voltage to an electrochemical cell comprising the liquid medium, a further solvent, an anode and a cathode to induce an electric current flow from the anode to the cathode, wherein the voltage is effective to induce a reduction of the metal ions on the cathode; and wherein the further solvent is substantially immiscible with the liquid medium and is in flow communication with the cathode; wherein the electrochemical cell further comprises a separator positioned between the cathode and anode, and wherein the separator is substantially permeable and selective to the metal ions; applying a magnetic field directed orthogonally to the current flow to induce an azimuthal motion of the liquid medium, thereby rotating the liquid medium around the cathode; depositing reduced metal on the cathode; and recovering the reduced metal.

Example 103

A method for selective recovery of a metal from a liquid medium comprising ions of the metal wherein the method comprises: applying a voltage to an electrochemical cell comprising the liquid medium, a further solvent, an anode and a cathode to induce an electric current flow from the anode to the cathode, wherein the voltage is effective to induce a reduction of the metal ions on the cathode; and wherein the further solvent is substantially immiscible with the liquid medium and is in flow communication with the cathode; wherein the electrochemical cell further comprises a separator positioned between the cathode and anode, and wherein the separator is substantially permeable and selective to the metal ions; depositing reduced metal on the cathode; and recovering the reduced metal.

Example 104

A method for selective recovery of a metal from a liquid medium comprising ions of the metal wherein the method comprises: applying a voltage to an electrochemical cell comprising the liquid medium, an anode and a cathode to induce an electric current flow from the anode to the cathode, wherein the voltage is effective to induce a reduction of the metal ions on the cathode; depositing reduced metal on the cathode; wherein the deposited reduced metal forms a plurality of fractal dendrites, a mossy structure, a needle-like structure, or a combination thereof on the cathode; and recovering the reduced metal.

Example 105

The method of any examples herein, particularly example 104, wherein the liquid medium comprises an aqueous solution, an organic solution, a nonaqueous solution, or a combination thereof.

Example 106

The method of any examples herein, particularly example 104 or 105, wherein the metal comprises lithium, sodium, magnesium, calcium, potassium, barium, or one or more rare earth elements, or alloys thereof.

Example 107

The method of any examples herein, particularly examples 104-106, wherein the metal ions are present in an amount of less than about 2,000 ppm in the liquid medium.

Example 108

The method of any examples herein, particularly examples 104-107, wherein the reduced metal is continuously removed from the cathode.

Example 109

The method of any examples herein, particularly examples 104-108, wherein the electrochemical cell further comprises a further solvent.

Example 110

The method of any examples herein, particularly example 109, wherein the further solvent is an organic solvent that is selective to the metal to be deposited.

Example 111

The method of any examples herein, particularly example 110, wherein the organic solvent comprises dimethyl carbonate, diethyl carbonate, ethyl methyl carbonate, polyoxylene, propylene carbonate, fluoroethylene carbonate, ethylene carbonate, room-temperature ionic liquids, or any combination thereof.

Example 112

The method of any examples herein, particularly examples 109-111, wherein the further solvent further comprises one or more metal selectivity improving additives.

Example 113

The method of any examples herein, particularly example 112, wherein the one or more metal selectivity improving additives comprise a chelating agent, $TiO_2$, or any combination thereof.

Example 114

The method of any examples herein, particularly examples 109-113, wherein the further solvent has a density that is substantially similar to a density of the liquid medium.

Example 115

The method of any examples herein, particularly examples 104-114, wherein the cathode and anode have the same or different geometrical shape.

Example 116

The method of any examples herein, particularly examples 104-115, wherein the cathode is a rotating electrode.

Example 117

The method of any examples herein, particularly examples 104-116, further comprises a step of applying a magnetic field directed orthogonally to the current flow to induce an azimuthal motion of the liquid medium, thereby rotating the liquid medium around the cathode.

Example 118

The method of any examples herein, particularly example 117, wherein the anode and cathode are disposed concentrically such that the anode is positioned around the cathode at a radial distance.

Example 119

The method of any examples herein, particularly examples 117 or 118, wherein the current flow is a radial current flow.

Example 120

The method of any examples herein, particularly examples 117-119, wherein the magnetic field induces continuous advection of the liquid medium.

Example 121

The method of any examples herein, particularly examples 117-120, wherein the magnetic field forms an electromagnetic centrifuge.

Example 122

The method of any examples herein, particularly examples 104-121, wherein the liquid medium comprises ions of one or more of lithium, sodium, magnesium, calcium, potassium, barium, or one or more rare earth elements, or any combination thereof.

Example 123

The method of any examples herein, particularly examples 104-122, wherein the voltage is from about −5V to about 5 V.

Example 124

The method of any one of any examples herein, particularly examples 117-123, wherein the magnetic field is applied at from about 1 mT to about 0.2 T.

Example 125

The method of any one of any examples herein, particularly examples 104-124, further comprising disposing a separator, wherein the separator is substantially permeable and selective to the metal ions.

Example 126

The method of any examples herein, particularly example 125, wherein the separator is configured to partition the further solvent from the liquid medium.

Example 127

The method of any examples herein, particularly example 125 or 126, wherein the separator comprises a metal-organic framework (MOF), polyethylene terephthalate membrane, cellulose acetate butyrate), polysulfone, polybenzimidazole, poly(amideimide), polyethersulfone, polyphenylsulfone, polyimide, polyacrylonitile, poly(ethylene oxide), poly (ether ether ketone), poly(vinylidene fluoride), poly(ethylene ch lorotrifluoroethylene), polycarbonate, polystyrene, poly(ether-block-amide), acrylonitrile butadiene styrene, bisphonenolsulfone, carbon nanotubes, or derivatives and combinations thereof.

Example 128

The method of any examples herein, particularly examples 104-127, wherein the metal is recovered in situ.

Example 129

The method of any examples herein, particularly examples 104-128, wherein the method is a batch method or a continuous method.

Example 130

The method of any examples herein, particularly examples 104-129, wherein the liquid medium is a geothermal brine, produced waters, wastewater, recycled batteries' electrolytes, seawater, desalination brines, aquifer brines, or any combination thereof.

Example 131

The method of any one of any examples herein, particularly examples 104-130, wherein the cathode comprises copper, carbon, graphite, sodium, lithium, $\lambda$-$MnO_2$ and $LiMn_2O_4$ spinel, olivine $LiFePO_4$ and $FePO_4$, or layered $LiNiMnO_2$.

Example 132

The method of any examples herein, particularly examples 104-131, wherein the anode comprises carbon or platinum.

Example 133

The method of any examples herein, particularly examples 104-132, wherein the deposited metal has a purity from greater than 20% to 100%.

Example 134

The method of any examples herein, particularly examples 104-133, wherein the deposited metal has a recovery yield from about 50% to 100%.

Example 135

The method of any examples herein, particularly examples 120-134, wherein a recovery rate is greater than about 1 $g/cm^2$ in 100 hours.

Example 136

The method of any examples herein, particularly example 135, wherein the recovery rate is about 1 $g/cm^2$ in 5 hours.

Example 137

A system comprising: a) an electrochemical cell comprising an anode and a cathode; wherein the cathode and anode have a longitudinal axis; b) wherein the electrochemical cell is configured to receive a liquid medium comprising metal ions such that the liquid medium is in fluid communication with the cathode; c) a magnet positioned to form a magnetic field parallel to the longitudinal axis of the cathode and anode such as to induce an azimuthal motion of the liquid medium; and wherein the system is selective to a metal deposition on the cathode.

Example 138

A system comprising: a) an electrochemical cell comprising an anode and a cathode; wherein the cathode and anode have a longitudinal axis; wherein the electrochemical cell is configured to selectively form a reduced metal deposited on the cathode; b) wherein the electrochemical cell is configured to receive a liquid medium comprising metal ions such that the liquid medium is in fluid communication with the cathode; and c) a metal removal member configured continuously to remove the reduced metal from the cathode.

Example 139

The system of any examples herein, particularly example 137 or 138, wherein the cathode and anode have the same or different geometrical shape.

Example 140

The system of any examples herein, particularly examples 137-139, wherein the cathode is a rotating electrode.

Example 141

The system of any examples herein, particularly examples 137-140, wherein the anode and cathode are concentrically disposed, such that the anode surrounds the cathode at a radial distance.

Example 142

The system of any examples herein, particularly examples 137-141, wherein the electrochemical cell is in electric communication with a voltage source such that a voltage is supplied between the anode and cathode.

Example 143

The system of any examples herein, particularly examples 137-142, wherein the metal comprises lithium, sodium, magnesium, calcium, potassium, barium, or one or more rare earth elements, or alloys thereof.

Example 144

The system of any examples herein, particularly examples 137-143, wherein the metal ions are present in an amount of less than about 2,000 ppm in the liquid medium.

Example 145

The system of any examples herein, particularly example 138, further comprises a magnet positioned to form a magnetic field parallel to the longitudinal axis of the cathode and anode, such as to induce an azimuthal motion of the liquid medium.

Example 146

The system of any examples herein, particularly examples 137 or 139-145, wherein the magnet is a permanent magnet or an electromagnet.

Example 147

The system of any examples herein, particularly examples 137 or 139-146, wherein the magnet is positioned beneath the electrochemical cell.

Example 148

The system of any examples herein, particularly examples 137 or 139-147, wherein the magnetic field is configured to induce continuous advection of the aqueous solution.

Example 149

The system of any examples herein, particularly examples 137 or 139-148, wherein the magnetic field is configured to form an electromagnetic centrifuge.

Example 150

The system of any examples herein, particularly examples 137-149, wherein the liquid medium comprises ions of one or more of lithium, sodium, magnesium, calcium, potassium, barium, or one or more rare earth elements.

Example 151

The system of any examples herein, particularly examples 142-150, wherein the voltage source is configured to provide a voltage from about −5V to about 5 V.

Example 152

The system of any examples herein, particularly examples 137 or 139-151, wherein the magnetic field is from about 1 mT to about 0.2 T.

Example 153

The system of any examples herein, particularly examples 137-152, wherein the electrochemical cell further comprises an organic solvent that is substantially immiscible with the liquid medium and is in flow communication with the cathode.

Example 154

The system of any examples herein, particularly example 153, wherein the organic solvent is a metal selective organic solvent.

Example 155

The system of any examples herein, particularly examples 153-154, wherein the organic solvent comprises dimethyl carbonate, diethyl carbonate, ethyl carbonate, polyoxylene, propylene carbonate, fluoroethylene carbonate, ethylene carbonate, room-temperature ionic liquids, or any combination thereof.

Example 156

The system of any examples herein, particularly examples 153-155, wherein the organic solvent further comprises one or more metal selectivity improving additives.

Example 157

The system of any examples herein, particularly examples 153-156, wherein the organic solvent has a density that is substantially similar to a density of the liquid medium.

Example 158

The system of any examples herein, particularly examples 153-157, wherein the electrochemical cell further comprises a separator that partitions the organic solvent from the liquid medium, wherein the separator is substantially permeable to the metal ions and is selective to the metal ions.

Example 159

The system of any examples herein, particularly example 158, wherein the separator comprises a metal-organic framework (MOF), polyethylene terephthalate membrane, cellulose acetate butyrate), polysulfone, polybenzimidazole, poly (amideimide), polyethersulfone, polyphenylsulfone, polyimide, polyacrylonitile, poly(ethylene oxide), poly (ether ether ketone), poly(vinylidene fluoride), poly(ethylene chlorotrifluoroethylene), polycarbonate, polystyrene, poly(ether-block-amide), acrylonitrile butadiene styrene, bisphonenolsulfone, carbon nanotubes, or derivatives and combinations thereof.

Example 160

The system of any examples herein, particularly examples 137-159, wherein the deposited metal forms a plurality of fractal dendrites, a mossy structure, a needle-like structure, or a combination thereof on the cathode.

Example 161

The system of any examples herein, particularly examples 137-160, wherein the liquid medium is a geothermal brine, produced waters, wastewater, or any combination thereof.

Example 162

The system of any examples herein, particularly examples 137-161, wherein the cathode comprises copper, carbon, graphite, or sodium, potassium, lithium, $\lambda$-$MnO_2$, and $LiMn_2O_4$ spinel, olivine $LiFePO_4$, and $FePO_4$, or layered $LiNiMnO_2$.

Example 163

The system of any examples herein, particularly examples 137-162, wherein the anode comprises carbon or platinum.

Example 164

The system of any examples herein, particularly examples 137-163, wherein the deposited metal has a purity from greater than 20% to 100%.

Example 165

The system of any examples herein, particularly examples 137-164, wherein the deposited metal has a recovery yield from about 50% to 100%.

Example 166

The system of any examples herein, particularly examples 137-165, wherein a recovery rate of the metal is greater than about 1 $g/cm^2$ in 100 hours.

Example 167

The system of any examples herein, particularly example 166, wherein the recovery rate is about 1 $g/cm^2$ in 5 hours.

Example 168

A device comprising the system of any examples herein, particularly examples 137-167.

Example 169

A method for selective recovery of a metal from a liquid medium comprising ions of the metal, wherein the method comprises: applying a voltage to an electrochemical cell comprising the liquid medium, an anode and a cathode to induce an electric current flow from the anode to the cathode, wherein the voltage is effective to induce a reduction of the metal ions on the cathode; applying a magnetic field directed orthogonally to the current flow to induce a convectional motion of the liquid medium, thereby moving the liquid medium around the cathode; depositing reduced metal on the cathode; and recovering the reduced metal.

Example 170

A system comprising: a) an electrochemical cell comprising an anode and a cathode; wherein the cathode and anode have a longitudinal axis; b) wherein the electrochemical cell is configured to receive a liquid medium comprising metal ions such that the liquid medium is in fluid communication with the cathode; c) a magnet positioned to form a magnetic field parallel to the longitudinal axis of the cathode and anode, wherein when there is a current flow from the anode to the cathode, the magnetic field is orthogonal to the current flow and induces a convectional motion of the liquid medium; and wherein the system is selective to a metal deposition on the cathode.

REFERENCES

United States Geological Survey (USGS). *Mineral Commodity Summaries* 2020; 2020.

Albemarle. Global Lithium Market Outlook. *Goldman Sachs HCID Conf.* 2016, No. March, 30.

Blondes, M. S.; Gans, K. D.; Engle, M. A.; Kharaka, Y. K.; Reidy, M. E.; Saraswathula, V.; Thordsen, J. J.; Rowan, E. L.; Morrissey, E. A. *U.S. Geological Survey National*

*Produced Waters Geochemical Database* (Ver. 2.3, January 2018): *U.S. Geological Survey Data Release;* 2018.

Li, L.; Deshmane, V. G.; Paranthaman, M. P.; Bhave, R.; Moyer, B. A.; Harrison, S. Lithium Recovery from Aqueous Resources and Batteries: A Brief Review. *Johnson Matthey Technol. Rev.* 2018, 62 (2), 161-176.

Flexer, V.; Baspineiro, C. F.; Galli, C. I. Lithium Recovery from Brines: A Vital Raw Material for Green Energies with a Potential Environmental Impact in Its Mining and Processing. *Sci. Total Environ.* 2018, 639.

Whittingham, M. S. Electrical Energy Storage and Intercalation Chemistry. *Science* (80-.). 1976, 192.

Goodenough, J. B.; Park, K. S. The Li-Ion Rechargeable Battery: A Perspective. *J. Am. Chem. Soc.* 2013.

Eric C. Evarts. To the Limits of Lithium. *Nature* 2015, 526, S93-S95.

Chan, C. K.; Peng, H.; Liu, G.; Mcllwrath, K.; Zhang, X. F.; Huggins, R. A.; Cui, Y. High-Performance Lithium Battery Anodes Using Silicon Nanowires. *Nat. Nanotechnol.* 2008, 3 (1), 31-35.

Halsey, T. C.; Leibig, M. Electrodeposition and Diffusion-Limited Aggregation Electrodepositlon and Diffusion-Limited Aggregation. *J. Chem. Phys.* 1990, 92. https://doi.org/10.1063/1.457834.

Sander, L. M. Fractal Growth Processes. *Nature* 1986, 322 (6082), 789-793.

Ragsdale, S. R.; Lee, J.; Gao, X.; White, H. S. Magnetic Field Effects in Electrochemistry. Voltammetric Reduction of Acetophenone at Microdisk Electrodes. *J. Phys. Chem.* 1996, 100 (14), 5913-5922.

Razmjou, A.; Eshaghi, G.; Orooji, Y.; Hosseini, E.; Korayem, A. H.; Mohagheghian, F.; Boroumand, Y.; Noorbakhsh, A.; Asadnia, M.; Chen, V. Lithium Ion-Selective Membrane with 2D Subnanometer Channels. *Water Res.* 2019, 159, 313-323.

Razmjou, A.; Asadnia, M.; Hosseini, E.; Habibnejad Korayem, A.; Chen, V. Design Principles of Ion Selective Nanostructured Membranes for the Extraction of Lithium Ions. *Nat. Commun.* 2019, 10 (1), 1-16.

Huang, W.; Attia, P. M.; Wang, H.; Renfrew, S. E.; Jin, N.; Das, S.; Zhang, Z.; Boyle, D. T.; Li, Y.; Bazant, M. Z.; et al. Evolution of the Solid—Electrolyte Interphase on Carbonaceous Anodes Visualized by Atomic-Resolution Cryogenic Electron Microscopy. *Nano Lett.* 2019, 19, 5140-5148.

Bai, P.; Li, J.; Brushett, F. R.; Bazant, M. Z. Transition of Lithium Growth Mechanisms in Liquid Electrolytes. *Energy Environ. Sci.* 2016, 9 (10), 3221-3229. https://doi.org/10.1039/c6ee01674j.

Liu, K.; Liu, Y.; Lin, D.; Pei, A.; Cui, Y. Materials for Lithium-Ion Battery Safety. *Sci. Adv.* 2018, 4 (6).

Hinds, G.; Spada, F. E.; Coey, J. M. D.; Ní Mhíocháin, T. R.; Lyons, M. E. G. Magnetic Field Effects on CopperElectrolysis. *J. Phys. Chem. B* 2001, 105 (39), 9487-9502. https://doi.org/10.1021/jp010581u.

Waskaas, M. Short-Term Effects of Magnetic Fields on Diffusion in Stirred and Unstirred Paramagnetic Solutions. *J. Phys. Chem.* 1993, 97 (24), 6470-6476. https://doi.org/10.1021/j100126a023.

Lee, D. A.; Taylor, W. L.; McDowell, W. J.; Drury, J. S. Solvent Extraction of Lithium. *J. Inorg. Nucl. Chem.* 1968, 30, 2807-2821.

What is claimed is:

1. A method comprising:

selectively recovering a metal from a liquid medium comprising metal ions of lithium, sodium, magnesium, calcium, potassium, barium, or one or more rare earth elements, or any combination thereof by applying a voltage to an electrochemical cell comprising the liquid medium, an anode and a cathode to induce an electric current flow from the anode to the cathode, wherein the voltage is effective to induce a selective reduction of the metal ions on the cathode;

applying a magnetic field directed orthogonally to the electric current flow to induce an azimuthal motion of the liquid medium, thereby rotating the liquid medium around the cathode;

forming a selective centrifugal partitioning of metal ions towards the anode and cathode based on a mass-to-charge ratio of the metal ion;

depositing a selectively reduced metal on the cathode; and recovering the selectively reduced metal with a yield from about 20% to about 100%.

2. The method of claim 1, wherein the liquid medium comprises an aqueous solution, an organic solution, a non-aqueous solution, or a combination thereof.

3. The method of claim 1, wherein the metal comprises lithium, sodium, magnesium, calcium, potassium, barium, one or more rare earth elements, or alloys thereof.

4. The method of claim 1, wherein the metal ions are present in an amount of less than about 2,000 ppm in the liquid medium.

5. The method of claim 1, wherein the selectively reduced metal forms a plurality of fractal dendrites, a mossy structure, a needle-like structure, or a combination thereof on the cathode.

6. The method of claim 1, wherein the anode and cathode are disposed concentrically such that the anode is positioned around the cathode at a radial distance, and wherein the electric current flow is a radial current flow.

7. The method of claim 1, wherein the magnetic field induces a continuous advection of the liquid medium and/or the magnetic field forms an electromagnetic centrifuge.

8. The method of claim 1, wherein the voltage is from about −5V to about 5 V and/or wherein the magnetic field is applied at from about 1 MT to about 0.2 T.

9. The method of claim 1, wherein the electrochemical cell further comprises a further solvent that is substantially immiscible with the liquid medium and is in flow communication with the cathode.

10. The method of claim 9, wherein the further solvent is an organic solvent that is selective to the metal to be deposited and comprises dimethyl carbonate, diethyl carbonate, ethyl methyl carbonate, polyoxylene, propylene carbonate, fluoroethylene carbonate, ethylene carbonate, room-temperature ionic liquids, or any combination thereof.

11. The method of claim 10, wherein the organic solvent further comprises one or more metal selectivity improving additives comprising a chelating agent, $TiO_2$, or any combination thereof.

12. The method of claim 9, further comprising disposing a separator, wherein the separator is substantially permeable and selective to the metal ions and is configured to partition the further solvent from the liquid medium and wherein the separator comprises a metal-organic framework (MOF), polyethylene terephthalate membrane, cellulose acetate butyrate), polysulfone, polybenzimidazole, poly(amideimide), polyethersulfone, polyphenylsulfone, polyimide, polyacrylonitile, poly(ethylene oxide), poly(ether ether ketone), poly(vinylidene fluoride), poly(ethylene chlorotrifluoroethylene), polycarbonate, polystyrene, poly(ether-block-amide), acrylonitrile butadiene styrene, bisphonenolsulfone, carbon nanotubes, or derivatives and combinations thereof.

13. The method of claim 1, wherein the liquid medium is a geothermal brine, produced waters, wastewater, recycled batteries' electrolytes, seawater, desalination brines, aquifer brines, or any combination thereof.

14. The method of claim 1, wherein the cathode comprises copper, carbon, graphite, sodium, lithium, $\lambda$-$MnO_2$ and $LiMn_2O_4$ spinel, olivine $LiFePO_4$ and $FePO_4$, or layered $LiNiMnO_2$, and/or the anode comprises carbon or platinum.

15. The method of claim 1, wherein the selectively deposited reduced metal has a purity from greater than 20% to 100%.

16. A method comprising:

selectively recovering a metal from a liquid medium comprising metal ions of lithium, sodium, magnesium, calcium, potassium, barium, or one or more rare earth elements, or any combination thereof by applying a voltage to an electrochemical cell comprising the liquid medium, an anode and a cathode to induce an electric current flow from the anode to the cathode, wherein the voltage is effective to induce a selective reduction of the metal ions on the cathode;

applying a magnetic field directed orthogonally to the electric current flow;

forming a selective centrifugal partitioning of metal ions towards the anode and cathode based on a mass-to-charge ratio of the metal ion;

depositing a selectively reduced metal on the cathode; and recovering the selectively reduced metal with a yield from about 20% to about 100%.

17. The method of claim 1, wherein the selectively reduced metal is Li.

18. The method of claim 17, wherein any metal ions having a mass-to-charge ratio higher than $1\times10^{-4}$ g/C are not reduced.

19. The method of claim 1, wherein a metal recovery rate is greater than 5 g/cm$^2$ in 100 hours.

20. The method of claim 1, wherein the liquid medium has a pH that is acidic, basic, or neutral.

21. A method for selective recovery of a metal from a liquid medium comprising ions of the metal wherein the method comprises:

applying a voltage to an electrochemical cell comprising the liquid medium, an anode and a cathode to induce an electric current flow from the anode to the cathode, wherein the voltage is effective to induce a reduction of the metal ions on the cathode;

wherein the electrochemical cell comprises a separator, wherein the separator is substantially permeable and selective to the metal ions and wherein the separator comprises a metal-organic framework (MOF), polyethylene terephthalate membrane, cellulose acetate butyrate), polysulfone, polybenzimidazole, poly(amideimide), polyethersulfone, polyphenylsulfone, polyimide, polyacrylonitile, poly(ethylene oxide), poly (ether ether ketone), poly(vinylidene fluoride), poly (ethylene chlorotrifluoroethylene), polycarbonate, polystyrene, poly(ether-block-amide), acrylonitrile butadiene styrene, bisphonenolsulfone, carbon nanotubes, or derivatives and combinations thereof;

applying a magnetic field directed orthogonally to the electric current flow to induce an azimuthal motion of the liquid medium, thereby rotating the liquid medium around the cathode;

depositing a reduced metal on the cathode; and recovering the reduced metal.

22. A method for selective recovery of a metal from a liquid medium comprising ions of the metal wherein the method comprises:

applying a voltage to an electrochemical cell comprising the liquid medium, an anode and a cathode to induce an electric current flow from the anode to the cathode, wherein the voltage is effective to induce a reduction of the metal ions on the cathode;

wherein the electrochemical cell further comprises a further solvent that is substantially immiscible with the liquid medium and is in flow communication with the cathode and a separator, wherein the separator is substantially permeable and selective to the metal ions and is configured to partition the further solvent from the liquid medium and wherein the separator comprises a metal-organic framework (MOF), polyethylene terephthalate membrane, cellulose acetate butyrate), polysulfone, polybenzimidazole, poly(amideimide), polyethersulfone, polyphenylsulfone, polyimide, polyacrylonitile, poly(ethylene oxide), poly(ether ether ketone), poly(vinylidene fluoride), poly(ethylene chlorotrifluoroethylene), polycarbonate, polystyrene, poly (ether-block-amide), acrylonitrile butadiene styrene, bisphonenolsulfone, carbon nanotubes, or derivatives and combinations thereof;

applying a magnetic field directed orthogonally to the electric current flow to induce an azimuthal motion of the liquid medium, thereby rotating the liquid medium around the cathode;

depositing a reduced metal on the cathode; and recovering the reduced metal.

* * * * *